US006707480B2

(12) United States Patent
Ameyama et al.

(10) Patent No.: US 6,707,480 B2
(45) Date of Patent: Mar. 16, 2004

(54) IMAGE FORMATION UNIT INCLUDING STORED PERFORMANCE INFORMATION

(75) Inventors: Minoru Ameyama, Tokyo (JP); Satoru Tomita, Tokyo (JP); Yasuyuki Shinkai, Tokyo (JP); Nekka Matsuura, Tokyo (JP); Katsuichi Ohta, Tokyo (JP); Naoya Morohoshi, Tokyo (JP); Akihisa Itabashi, Toyko (JP); Takanori Yano, Tokyo (JP); Katsuhiro Aoki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/102,633

(22) Filed: Mar. 22, 2002

(65) Prior Publication Data

US 2002/0135655 A1 Sep. 26, 2002

(30) Foreign Application Priority Data

Mar. 23, 2001 (JP) ..... 2001-085511
Feb. 26, 2002 (JP) ..... 2002-049777

(51) Int. Cl.[7] ..... G03G 15/00
(52) U.S. Cl. ..... 347/129; 399/12; 399/110
(58) Field of Search ..... 399/12, 24, 25, 399/110, 111, 31, 46; 347/129, 131

(56) References Cited

U.S. PATENT DOCUMENTS

| | | | | |
|---|---|---|---|---|
| 4,499,849 | A | 2/1985 | Tomita et al. | |
| 4,547,059 | A | 10/1985 | Nagayama et al. | |
| 4,571,070 | A | 2/1986 | Tomita | |
| 5,105,222 | A | 4/1992 | Ohta et al. | |
| 5,172,161 | A | * 12/1992 | Nelson | 347/129 |
| 5,875,380 | A | 2/1999 | Iwata et al. | |
| 5,953,567 | A | 9/1999 | Muramatsu et al. | |
| 5,987,298 | A | 11/1999 | Muramatsu et al. | |
| 6,016,409 | A | * 1/2000 | Beard et al. | 399/33 |
| 6,112,046 | A | 8/2000 | Suzuki et al. | |
| 6,122,468 | A | 9/2000 | Sakamoto et al. | |
| 6,128,459 | A | 10/2000 | Iwata et al. | |
| 6,142,690 | A | 11/2000 | Yoshimura et al. | |
| 6,163,669 | A | 12/2000 | Aoki et al. | |
| 6,201,941 | B1 | 3/2001 | Kasahara et al. | |
| 6,249,304 | B1 | 6/2001 | Sawayama et al. | |
| 6,282,396 | B1 | 8/2001 | Iwata et al. | |
| 9,295,437 | | 9/2001 | Hodoshima, et al. | |
| 6,381,057 | B1 | 4/2002 | Itabashi | |
| 6,381,435 | B2 | 4/2002 | Shinohara et al. | |
| 6,393,241 | B1 | 5/2002 | Matsumoto et al. | |
| 6,400,391 | B1 | 6/2002 | Suhara et al. | |
| 6,429,956 | B2 | 8/2002 | Itabashi | |
| 6,459,860 | B1 | * 10/2002 | Childers | 399/12 |
| 6,469,772 | B1 | 10/2002 | Itabashi | |
| 6,505,022 | B2 | 1/2003 | Kosuge et al. | |
| 6,507,720 | B2 | 1/2003 | Kabumoto et al. | |

FOREIGN PATENT DOCUMENTS

| | | |
|---|---|---|
| JP | 2-220070 | 9/1990 |
| JP | 6-19233 | 1/1994 |
| JP | 2000-89642 | 3/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A plurality of types of engine units which have nonvolatile storage units and which have different performances, respectively, can be attached to an image formation apparatus main body in a replaceable manner. A control unit which controls the performance of an overall apparatus based on information stored in the storage units provided in the engine units, respectively, which are attached to the image formation apparatus main body, is provided in the image formation apparatus main body. Therefore, even if the image formation apparatus main body is common, the performance of the overall apparatus related to recording speed or resolution can be changed only by replacing the engine units different in performance. It is also possible to easily deal with various types of apparatuses.

7 Claims, 16 Drawing Sheets

IMAGE FORMATION UNIT INCLUDING STORED PERFORMANCE INFORMATION

FIELD OF THE INVENTION

The present invention relates to an image formation unit used in a copier, a facsimile machine or a printer and to an image formation apparatus which includes this image formation unit.

BACKGROUND OF THE INVENTION

In recent years, market demand in relation to the performances of image formation apparatuses such as recording speed, resolution and rise time has diversified and various types of image formation apparatuses which differ in these performances are required. However, as the diversified apparatus types appear, the number of the types of necessary components and units increases.

In addition, time for a user to change desired performances has recently become shorter. Specifically, time for a user who purchased an image formation apparatus of a certain type to obtain an image formation apparatus of another type because the user could not correctly recognize the quantity of print output at the time of purchase or the quantity of print output changes from that when the user purchased the apparatus, has become shorter.

According to a conventional image formation apparatus, if the above instance occurs, a user disadvantageously needs to purchase another image formation apparatus, which imposes heavy burden on the user. Further, on the manufacturers' side, if many types of apparatuses are produced, manufacturing cost is disadvantageously pushed up.

On the other hand, the image formation apparatus such as a copier or a printer is required to be subjected to maintenance operations frequently while the apparatus is used. This is because image formation processes are carried out while preserving a delicate balance, and it is necessary to adjust the balance between the components of the apparatus to ensure good image formation. The maintenance operations are required due to, for example, the fact that if low quality paper is used, paper particles adhere to a photosensitive member to make it impossible to ensure good image formation or due to the degradation of rubber members.

As for an image formation unit around a photosensitive member which unit is provided to realize an electrophotographic method, in particular, a maintenance operation is highly demanded so as to make the best use of the performances of the unit. Conventionally, the image formation unit of the photosensitive member or the like used in an image formation apparatus is shorter in life than the image formation apparatus. It is, therefore, necessary to replace the image formation unit by a new one several times while one image formation apparatus is used. The image formation unit has a shorter life because of a phenomenon that the photosensitive member is worn because of the impact of, for example, a cleaning blade on the photosensitive member or, if the apparatus of a two-component development type is used, because of a spent toner phenomenon that a toner adheres to a carrier after the apparatus has been used for a long period of time to thereby deteriorate the charging performance of the unit or the like.

As a result, it is necessary to carry out maintenance operations including the repair or replacement of the image formation unit while the image formation apparatus is used. The maintenance operations are roughly divided into maintenance centered around repairs made by engineers such as manufacture's service persons and that centered around replacement made by the user himself.

In the maintenance on the part of service persons or the like, the image formation unit is also repaired if possible and the quantity of waste to be disposed of can be advantageously reduced. On the other hand, the maintenance disadvantageously generates time or so-called downtime for which the user cannot use the image formation apparatus before a service person returns the apparatus to the user. In the context of the field of printers which is particularly widening or the overseas sales of printers, there is fear that maintenance operations cannot be conducted to image formation apparatuses at sufficiently earlier time because users outnumbers service persons or the distance from a service center to the user is long.

Meanwhile, there is conventionally known, as an image formation apparatus enabling a user to carry out maintenance operations, a process cartridge type image formation apparatus in which a photosensitive member is formed integrally with a development device and the integrated photosensitive member and development device are detachable from the main body of the image formation apparatus. Since the photosensitive member and the image formation unit such as a development device are formed integrally with each other, the process cartridge type image formation apparatus has an advantage in that the user can easily carry out a replacement operation if the life of the cartridge ends. The process cartridge type image formation apparatus has, however, disadvantages in that since a plurality of image formation units are formed integrally, it is necessary to replace the entire cartridge even if the life of a part of the image formation units ends, cost is pushed up and heavy burden is imposed on the environment. As more attention has been recently paid to the environment, the recycle of process cartridges is underway. However, since the user can easily detach the process cartridge, some process cartridges are disposed of without being recovered, whereby the complete recovery of process cartridges is not realized.

As explained above, according to the conventional image formation apparatus, the image formation unit is almost a consumable supply in the sense that unless maintained, good image formation cannot be ensured for a long period of time and, therefore, the problem arises as to how to carry out various maintenance operations.

In this specification, an image formation unit which can be replaced by another unit and attached to an image formation apparatus will be referred to as "image formation unit" and the sections of the image formation apparatus other than the image formation unit will be referred to as "image formation apparatus main body" hereinafter unless otherwise specified. In addition, if a plurality of image formation units exist in an image formation apparatus, only the noted image formation unit will be referred to as "image formation unit" and the image formation units other than the noted image formation unit and the sections of the image formation apparatus other than the image formation units will be collectively referred to as "image formation apparatus main body" hereinafter.

Thanks to the recent technological innovation made by the applicant of the present invention, the lives of respective constituent members of an image formation apparatus are steadily lengthened. For example, the applicant of the present invention succeeded in developing a technique of lengthening the life of a photosensitive member the performance of which has been conventionally difficult to maintain until the life of an image formation apparatus ends. Such technological innovation enables the life of an image formation unit to be equal to that of an image formation apparatus main body or to nearly surpass the life of the image formation apparatus main body.

If the life of the image formation unit is longer, the number of times of necessary maintenance operations, quite naturally, decreases. If the number of times of necessary maintenance operations decreases, a service person can arrive at a user in short time after the service person receives a maintenance request from the user and the burden of maintenance on the user decreases, accordingly.

If the image formation unit, in particular, has a comparable life to that of the image formation apparatus main body and the image formation unit as well as the image formation apparatus which has been used is recovered when the user purchases or rents a new apparatus or the like, then it is possible to dispense with a maintenance operation.

If the life of an image formation unit is longer, it is considered that one image formation unit is recycled (reused) to be used with a plurality of image formation apparatus main bodies. If it is assumed that the life of an image formation unit is three times as long as that of an image formation apparatus main body, it is possible to use the image formation unit with three image formation apparatus main bodies without the need to carry out any maintenance operations. In addition, if the life of an image formation unit is shorter than that of an image formation apparatus main body and the user parts with the image formation unit before the end of the life of the unit because the performances of the image formation apparatus which the user requires change in a short period of time, then this image formation unit can be used with another image formation apparatus main body.

Nevertheless, even if it is possible to reuse an image formation unit, the image formation unit detached from one image formation apparatus cannot be reused with another type of an image formation apparatus. This is because image formation units have been conventionally manufactured for each type of an image formation apparatus (or for each type of an image formation apparatus main body).

Japanese Patent Application Laid-Open (JP-A) No. 2-220070 discloses a process cartridge which can be used with a plurality of image formation apparatus main bodies having different process speeds and which enables the image formation process conditions thereof to be changed in accordance with the process speed of each image formation apparatus main body. In addition, JP-A No. 6-19233 discloses a process cartridge detachable from a plurality of image formation apparatuses having different process speeds and an image formation apparatus which is devised to be capable of performing appropriate exposure and the like in view of the probability that such a process cartridge is attached to the apparatus.

According to these conventional arts, however, each process cartridge is adjusted to the inherent process speed of the image formation apparatus main body. As a result, user's demand for changing the performances of an image formation apparatus cannot be satisfied by the conventional arts, with the result that the user needs to purchase a new image formation apparatus.

SUMMARY OF THE INVENTION

It is an object of the present invention to provide an image formation unit and an image formation apparatus which can make it unnecessary to purchase another image formation apparatus main body if a user wants to have the performances of the image formation apparatus changed.

Further, one of the performances of an image formation apparatus which a user frequently wants changed is improved image quality or particularly improved pixel density (improved resolution).

It is, therefore, another object of the present invention to provide an image formation unit and an image formation apparatus which can change pixel density without the need to purchase a new image formation apparatus main body.

An image formation apparatus of such a type as to write a latent image on a photosensitive member using a writing unit which is an exposure unit has, however, a problem of the positional accuracy of the photosensitive member and the exposure unit. This problem will be explained below.

At present, as market demand for the improvement of image quality is rising, writing density is improved accordingly. Following the improved density, the diameter of a light beam for a writing of applied from an optical scanning device which serves as an exposure unit used to form a latent image on a photosensitive member, is made smaller in size (to 30 $\mu$m).

According to such an optical scanning device, if the beam diameter is smaller, the depth margin of the beam diameter (which is a range which satisfies the required specifications of the beam diameter including an allowance change) is narrower at a rate of the square of a change in beam diameter. If the beam diameter is narrowed up to about 30 $\mu$m, for example, the depth margin of the beam diameter is as small as about 1 mm. If so, the actual depth margin of the beam diameter is almost zero because of the accumulated processing errors of an optical element and a holding component such as a deflector and an imaging element which constitute the optical scanning device.

The irregularity of the distance between the optical scanning device and a photosensitive member which is a scanning target medium particularly has a great influence on the depth margin of the beam diameter. The distance therebetween varies from about 0.3 mm to about 0.5 mm, which irregularity occupies nearly half the depth margin of an optical system in a design phase.

For example, as shown in FIG. 24, a conventional optical scanning unit 1006 having a semiconductor laser (not shown) which serves as a light source, a deflector 1001, a plurality of lenses 1002 and 1003 such as fθ lenses and a folded mirror 1004 provided at predetermined positions of a housing 1005, respectively, is provided. The holding section (not shown) of a photosensitive member 1007 which serves as an image carrier is held by the frame (not shown) of an image formation apparatus main body. Various components are arranged between the housing 1005 and the photosensitive member 1007. As a result, the processing errors, assembly errors, deformations and the like of the respective components are accumulated, thereby causing a large positional error between the optical elements and the photosensitive body 1007. Reference symbol 1008 denotes a dustproof glass.

Further, as shown in FIG. 25, the photosensitive member 1007 is sometimes arranged to be inclined with respect to the scanning line L of the optical scanning unit 1006, which eventually, probably causes an output image to be inclined.

It is, therefore, yet another object of the present invention to provide an image formation unit and an image formation apparatus wherein even if pixel density is changed without replacing an image formation apparatus main body with another one, the irregularity of the distance between a scanning optical system, which functions as a writing unit in the image formation apparatus, and an image carrier is reduced, whereby it is possible to widen a depth margin, to satisfy the desired specifications of a beam spot diameter, to reduce the degradation of image quality, to compensate for the processing errors of other optical elements and a holding member by the widened depth margin and to increase the quantity of allowances allocated to the respective components.

Another performance of the image formation apparatus which the user wants changed is shortened fixing rise time which influences print finishing speed.

It is, therefore, still another object of the present invention to provide an image formation unit and an image formation apparatus which can change fixing rise time without the need to purchase a new image formation apparatus main body.

Other objects and features of this invention will become understood from the following description with reference to the accompanying drawings.

DETAILED DESCRIPTIONS

One embodiment of the present invention will be explained hereinafter with reference to FIGS. 1 to 23. In this embodiment, as will be explained later, an example of applying the present invention to an electrophotographic full-color image formation apparatus is shown.

An example of the configuration of a color image formation apparatus which includes an optical scanning device 100 (exposure unit+photosensitive member) constituted as explained later with reference to FIGS. 1 to 5, will first be explained with reference to FIG. 6 and the following.

Figure 6:
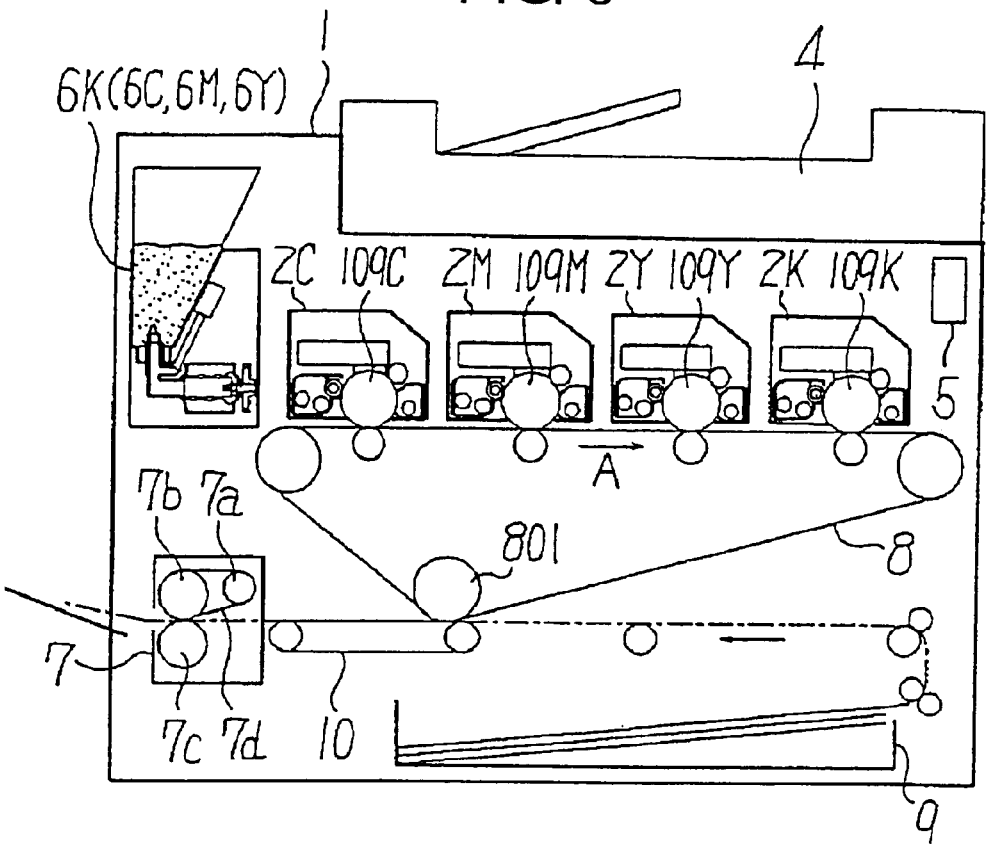
FIG. 6 is a schematic block diagram which shows the overall configuration of an image formation apparatus.

FIG. 6 shows one example of the schematic configuration of the overall color image formation apparatus in this embodiment. The overall operation of this image formation apparatus 1 is controlled by a controller 5. The controller 5 includes a CPU which performs various processings, a memory which stores images and the like.

In addition, this image formation apparatus 1 includes four optical scanning devices 100C, 100M, 100Y and 100K equal in structure and serving as exposure units, i.e., writing units which form electrostatic latent images corresponding to toner images having a color C (cyan), a color M (magenta), a color Y (yellow) and a color K (black), respectively. The structure of each of the optical scanning devices 100C, 100M, 100Y and 100K is conformable to any one of the structures shown in FIGS. 1 to 5 to be explained later. For example, the respective optical scanning devices are constituted so that these devices which serves as an image carrier together with photosensitive members 109C, 109M, 109Y and 109K which serve as image carriers are held in housings 114C, 114M, 114Y and 114K, respectively.

In this embodiment, four engine units (image formation units) 2C, 2M, 2Y and 2K which are equal in structure, into which the respective optical scanning devices 100C, 100M, 100Y and 100K are incorporated and which form toner images of C (cyan), M (magenta), Y (yellow) and K (black) colors on an intermediate transfer belt 8, respectively, are mounted on the image formation apparatus 1. Toners corresponding to the toner images of respective colors are supplied from four toner supply devices 6C, 6M, 6Y and 6K equal in structure and serving as toner supply units, to the engine units 2C, 2M, 2Y and 2K, respectively. The respective toner supply devices 6C, 6M, 6Y and 6K are arranged along the width direction of the intermediate transfer belt 8 which rotates in a direction indicated by an arrow A in FIG. 6 (see FIG. 15).

The outline of the image formation operation of the image formation apparatus 1 will next be explained.

In FIG. 6, digital image data obtained through a scanner 4 or a network line (not shown) is subjected to an image processing such as a gradation processing by the controller 5 and then fed, as a write signal, to the semiconductor laser (which corresponds to the semiconductor laser 101 shown in FIG. 1) of each of the optical scanning devices 100C, 100M, 100Y and 100K. The semiconductor lasers apply write beams according to this write signal, to the photosensitive members 109C, 109M, 109Y and 109K in the engine units 2C, 2M, 2Y and 2K, respectively. The respective engine units 2C, 2M, 2Y and 2K form toner images with colors corresponding to the write beams, on the photosensitive members 109C, 109M, 109Y and 109K and then sequentially transfer the toner images with the respective colors onto the intermediate transfer belt 8. At this moment, the controller 5 adjusts the write timing of each semiconductor laser so that the toner images with the respective colors on the intermediate transfer belt 8 are superimposed on one another to form a full-color image.

A toner image consisting of the full-color image formed on the intermediate transfer belt 8 is moved in the arrow A direction as the intermediate transfer belt 8 rotates. A transfer material which serves as a recording medium such as a transfer sheet or an OHP sheet is fed from a paper feed tray 9 toward the nip section between a transfer roller 801 which is one of the setting rollers rotatably setting the intermediate transfer belt 8, and a conveyer belt 10 arranged to be opposed to the transfer roller 801 across the intermediate transfer belt 8. At this moment, the transfer material is fed at timing at which the tip end of the image transfer region of the transfer material is consistent with that of the toner image transferred onto the intermediate transfer belt 8.

While the transfer material passes through the nip section, the toner image transferred onto the intermediate transfer belt 8 is collectively transferred onto the transfer material. The transfer material having the toner image thus collectively transferred is pressurized by a pair of pressure rollers 7*b* and 7*c* while the toner image is contacted with a fixing belt 7*d* heated by the heating roller 7*a* of the fixing device 7 and molten, whereby the toner image is fixed, and the transfer material is then discharged to the outside of the apparatus.

One example of the configuration of each of the engine units 2C, 2M, 2Y and 2K will next be explained.

Figure 7:
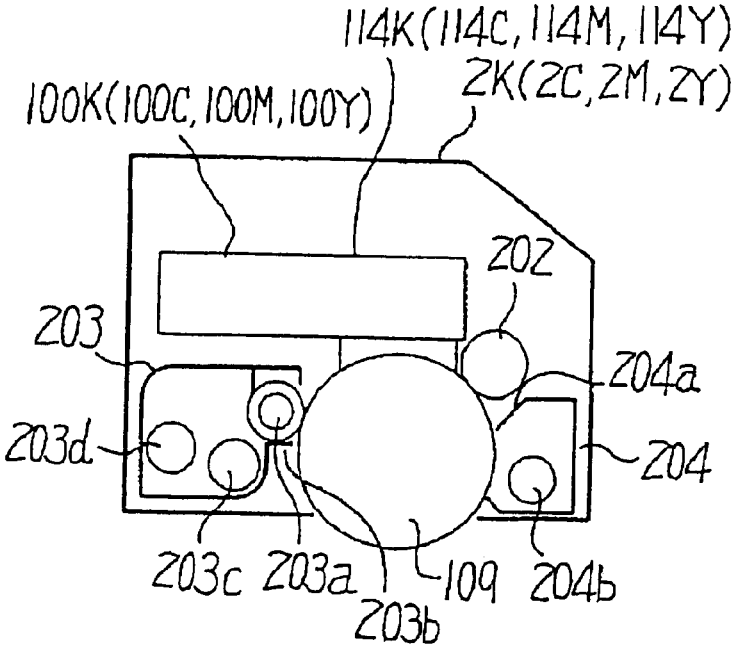
FIG. 7 is an enlarged, schematic block diagram which shows an engine unit mounted in the image formation apparatus main body of the image formation apparatus.

In this embodiment, the engine units 2C, 2M, 2Y and 2K are equal in structure and each constituted by integrating a plurality of process units associated with an electrophotographic process into one unit. As shown in FIG. 7, for example, in each of the engine units 2C, 2M, 2Y and 2K, a plurality of image formation units (process units) such as a photosensitive member 109 which serves as an image carrier, an optical scanning device 100 which serves as an exposure unit and which is held together with the photosensitive member 109 by a housing 114, a charging device 202 which consists of a charging roller serving as a charging unit charging the surface of the photosensitive member 109 and which is arranged around the photosensitive member 109, a development device 203 serving as a development unit which attaches charged toner to a latent image on the photosensitive member 109 and thereby forms a toner image on the photosensitive member 109, and a cleaning device 204 serving as a cleaning unit which removes residual toner on the photosensitive member 109 after the transfer of the toner image onto the intermediate transfer belt 8, are arranged in a plastic housing and integrated into one unit.

Figure 22:
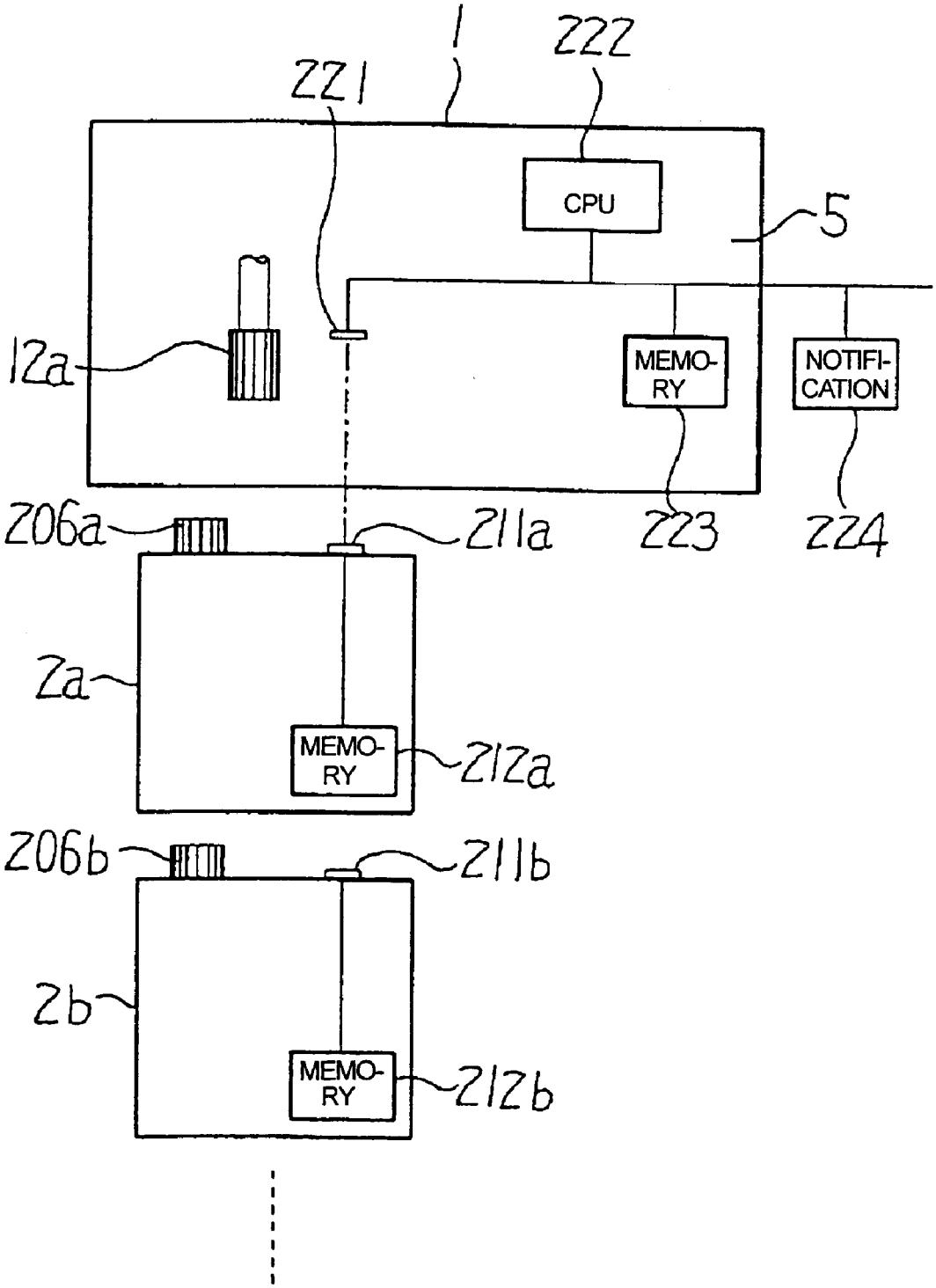
FIG. 22 is a typical explanatory view which extracts and shows the characteristic sections in this embodiment.

In this embodiment, a plurality of types of units which have the same outside structure and which differ in proper conditions related to performances such as recording speed and resolution, are prepared for each engine unit 2 (2C, 2M, 2Y or 2K). These engine units can be replaced by other engine units and attached to the same image formation apparatus. For example, FIG. 22 is a typical view which shows a manner in which a plurality of engine units 2*a*, 2*b*, . . . equal in outside structure and different in proper conditions for performances are prepared to be replaceable by other engine units and attachable to an image formation apparatus main body. The specifications of the engine unit 2*a* are, for example, a recording speed of 50 cpm and a resolution of 1200 dpi. The engine unit 2*a* has, therefore, relatively high speed, high resolution performances. The specifications of the engine unit 2*b* are, for example, a recording speed of 30 cpm and a resolution of 600 dpi and the engine unit 2*b* has, therefore, relatively low speed, low resolution performances.

The engine units 2*a*, 2*b*, . . . include memories 212*a*, 212*b*, . . . which serve as storage units including electrical connection terminals 211*a*, 211*b*, . . . connected to the image formation apparatus main body and gears 206*a*, 206*b*, . . . which transmit driving forces, respectively.

The memories 212*a*, 212*b*, . . . are nonvolatile memories and store, as electronic information, respective optimal recording speeds (=visible image formation speeds) for the engine units 2*a*, 2*b*, . . . , resolutions (=recording densities), the numbers of recorded sheets and process conditions for image formation which are changed according to the recording speeds and the resolutions, respectively. Alternatively, information on the respective process conditions for image formation which are changed according to the recording speeds and the resolutions may be stored in the image formation apparatus main body. According to the present invention, each of the engine units 2*a*, 2*b*, . . . holds the information which indicates its performances such as a recording speed and a resolution so that the image formation apparatus main body can acquire the information.

Furthermore, in this embodiment, the engine units 2*a*, 2*b*, . . . also store the estimated lives of the engine units 2*a*, 2*b*, . . . , respectively. The information on the number of recorded sheets and the estimated lives are rewritten and updated at random by the controller 5 which is provided in the image formation main body.

In the image formation apparatus main body, connection terminal 221 corresponding to the electrical connection terminals 211*a*, 211*b*, . . . and a driving gear 12*a* corresponding to the gears 206*a*, 206*b*, . . . are provided. In addition, the controller 5, which determines whether or not each engine unit is attached by reading the information stored in the memories 212*a*, 212*b*, . . . provided in the engine units 2*a*, 2*b*, . . . attached to and connected to the main body and which controls the image formation conditions, is provided in the image formation apparatus main body. Namely, in this embodiment, the functions of a performance acquisition unit and a control unit are executed by the controller 5. This controller 5 mainly consists of a CPU 222 and appropriately controls the rotational speed, charge voltage, development bias voltage, transfer voltage, fixing temperature and the like of each motor.

Specifically, a starting signal is transmitted from the CPU 222 to a motor controller to thereby rotate motors and, therefore, start the engines thereof. When each motor rotates, a transmission system, which is not shown, starts rotating the photosensitive member 109, the charging device 202, the development device 203 and the fixing device 7 of each unit. At this moment, the CPU 222 changes a rotation clock according to the recording speed specified by each engine unit 2 attached to the main body, thereby setting the motor rotational speed at an appropriate value for the engine unit 2. At this moment, it is also necessary to change all of the peripheral speeds of the pressure rollers 7*b* and 7*c*, the heating roller 7*a* and a paper feed roller which constitute the fixing device 7 in accordance with the engine unit 2. If these speeds are not uniformly set, the expansion or contraction of an image occurs in an output image sub-scanning direction.

Further, the image formation apparatus main body includes a memory 223 serving as a main body side storage unit. The memory 223 stores at least information on the respective recording speeds of the image formation apparatus main body, the number of recorded sheets per resolution, the estimated life of the main body and the like. The information is rewritten and updated by the CPU 222 depending on the status of the use of the apparatus.

By mounting the memories 212*a*, 212*b*, . . . 223 on the engine units 2*a*, 2*b*, . . . and the image formation apparatus main body, respectively, it is possible to individually store and manage the histories of the engine units 2*a*, 2*b*, . . . and that of the image formation apparatus main body. It is, therefore, possible to control the engine units and the image formation apparatus main body based on these histories if another engine unit is attached to the image formation apparatus main body for recycle or the engine units are attached to another image formation apparatus main body.

Furthermore, the CPU 222 of the controller 5 can perform arithmetic operations (as a life estimation unit) to the respective estimated lives of the apparatus main body and the engine units based on the history information on the lives stored in the memories 212*a*, 212*b*, . . . 223, writes the operation results in the memories 212*a*, 212*b*, . . . and 223, respectively and allows a notification unit 224 to notify or, if necessary, display the operation results. This can prevent the lives of the engine units 2*a*, 2*b*, . . . and the image formation apparatus main body from greatly differing from one another. Besides, since it is possible to check the estimated lives of the engine units 2*a*, 2*b*, . . . and the apparatus main body, the selection of a recycle item is facilitated and the selection of a more appropriate combination can be made.

The same thing is true if the engine units are attached to the control section of the image formation apparatus in a replaceable manner. In that instance, it is preferable that a type, a production number and the like are described on each of the engine units 2*a*, 2*b*, . . . or a tape or the like on which the type, the production number and the like are written is bonded to each of the engine units 2*a*, 2*b*, . . . so as to avoid a combination error.

According to this embodiment, as can be seen from the above, one common image formation apparatus main body is provided, a plurality of types of engine units 2*a*, 2*b*, . . . having different performances are replaceable and attachable to the common main body, and the image formation conditions (the performances of the overall apparatus) are controlled in accordance with the performances of the attached engine unit 2*a*, 2*b* . . . . Therefore, even if the image formation apparatus main body is common, it is possible to obtain an image at a stable recording speed with a stable resolution and to thereby easily deal with various types of apparatuses. Alternatively, two types of engine units such as low speed/intermediate speed engine units or intermediate speed/high speed engine units may be prepared for an image formation apparatus main body which can operate at, for example, low speed/intermediate speed/high speed. In addition, if two or three types of image formation apparatus main bodies such as low speed/high speed main bodies or low speed/intermediate speed/high speed main bodies are prepared, it is possible to set the type of the apparatus with the balance between the performances and the cost being kept in the combination between the image formation apparatus main body and the engine units 2*a*, 2*b*, . . . having different performances.

In those instances, if an engine unit (image formation unit) having a performance which the image formation apparatus main body cannot deal with, is erroneously attached to the main body, it suffices to notify a user or the like of the situation through the notification unit 224. By doing so, it is possible to avoid using a combination of the image formation apparatus main body with the engine unit (image formation unit) which cannot exhibit its performance if the unit is attached to the main body.

Moreover, if a user which uses a certain type of an image formation apparatus needs an image formation apparatus having higher recording speed, it is possible to provide an image formation apparatus having the performance which the user desires at low cost only by replacing the engine units 2*a*, 2*b*, . . . without the need to purchase a new image formation apparatus. Likewise, if a user which uses a certain type of an image formation apparatus needs an image formation apparatus having higher image quality, it is possible to provide an image formation apparatus having the performance which the user desires at low cost only by replacing the engine units 2*a*, 2*b*, . . . without the need to purchase anew image formation apparatus.

According to the image formation apparatus in this embodiment to which a plurality of engine units can be attached, there is a probability that engine units having different performances are erroneously attached to the apparatus. Therefore, the controller 5 in this embodiment includes a unit which determines whether or not all the engine units are equal performance if acquiring performance information from the engine units, and which notifies, if an engine unit having different performances is mixed with the other engine units, that the engine unit exists. The notification is given by, for example, displaying information such as "since engine units which can form 50 images per minute for cyan and magenta are attached to the apparatus and engine units which can form 30 image per minute for yellow and black are attached, image formation cannot be performed" on a control panel.

Various configurations are available for the unit which determines whether or not all the engine units are equal in performances. In this embodiment, for example, the controller 5 extracts information on performances from the information acquired from the engine units, obtains an exclusive-OR (XOR) thereof and determines whether or not the XOR is 0.

In addition, it is preferable that this notification is given before each engine units carries out an image formation operation or a preparation operation. This is because if the user is given such a notification before the image formation operation or the preparation operation starts, it is possible to return or replace an erroneously attached engine unit while being kept new.

If the performance difference between the engine units is linear speed, the engine units having different performances cannot be used in one image formation apparatus. However, if the performance different is pixel density or the like, the apparatus can perform image formation. In the latter instance, a user may determine whether or not the engine units having different performances are to be used. In this instance, a notification can be given by, for example, displaying a message such as "engine units which can form images with a pixel density of 1200 dpi for cyan and magenta and engine units which can form images with a pixel density of 600 dpi for yellow and black are attached. Although an image has different texture according to colors, do you want to start image formation with these units attached as they are or do you want to replace the engine units to make texture uniform?" on the control panel.

Further, in this embodiment, the fixing device 7 is replaceable and attachable to the apparatus independently as one of the image formation units. That is, the image formation apparatus in this embodiment has such a performance that a plurality of fixing devices different in fixing rise time are replaceable and attachable to the apparatus. More specifically, a fixing device C which takes, for example, 30 seconds since the image formation apparatus in a stopped state is turned on until the apparatus turns into an fixable state or since the image formation apparatus which is turned on but is in a dormant state receives an image formation instruction until the apparatus turns into a fixable state, and a fixing device C which takes, for example, 60 seconds since the image formation apparatus in a stopped state is turned on until the apparatus turns into an fixable state or since the image formation apparatus which is turned on but is in a dormant state receives an image formation instruction until the apparatus turns into a fixable state, are prepared. The fixing devices C and D are equal in outside structure and replaceable. However, time required for the image formation apparatus which is turned on but in a dormant state to turn into a fixable state, changes according to the thickness of the heating roller 7*a*. For that reason, a thinner heating roller than that used in the fixing device D is used in the fixing device C.

Each of these fixing devices C and D includes a nonvolatile memory which stores, as electronic information, information on the performances of the device (rise time from the stopped state or the dormant state). As in the instance of the engine unit 2, if the fixing device C or D is attached and connected to the image formation apparatus main body, the main body acquires information on the performances of the fixing device C or D from the memory. The controller 5 adjusts image formation operation start time in accordance with the acquired fixing rise time. This adjustment can be executed simply by adjusting the timing at which an image formation start instruction is issued.

As can be seen, according to this embodiment, it is possible to change fixing rise time only by replacing the fixing device C or D without the need to change the image formation apparatus main body.

The constituent elements of a plurality of types of engine units having different performances such as recording speed and resolution, will next be explained in detail one by one.

In the following explanation, the two types of engine units 2*a* and 2*b* will be explained by way of example. That is, the engine unit 2*a* has a recording speed of 50 cpm and a resolution of 1200 dpi, i.e., has relatively high speed, relatively high resolution performances. The engine unit 2*b* has a recording speed of 30 cpm and a resolution of 600 dpi, i.e., has relative low speed, relatively low resolution performances.

Sections common to the engine units 2*a* and 2*b* will first be explained and then a section different between the engine units 2*a* and 2*b* so that the engine units 2*a* and 2*b* have different recording speeds and resolutions will be explained.

A. Sections common to the engine units 2*a* and 2*b* having different recording speeds and resolutions

[Charging Device 202]

The charging device 202 is a device which uniformly charges the surface of the photosensitive member 109. In this embodiment, a contact charge type by means of a charging roller is used. The charging roller which serves as the charging device 202 is basically constituted so that a core and a roller-shaped charging rubber layer concentric with the outer periphery of the core are provided.

The both ends of the core of the charging roller are rotatably held by a bearing member or the like and the charging roller is pressurized against the photosensitive member 109 with a predetermined pressure force by a pressurization unit, which is not shown, and rotated while contacting with the photosensitive member 109.

In addition, in the charging roller, the intermediate resistance rubber layer having a resistance of about 100 kΩcm is coated on the core having a diameter of 9 mm and formed to have a diameter of 16 mm, for example. Further, the core of the charging roller is electrically connected to a power supply (not shown). By applying a predetermined bias to the charging roller from this power supply, the peripheral surface of the photosensitive member 109 is charged at a predetermined potential having predetermined polarity.

[Development Device 203]

The development device 203 is a device which attaches charged toner to a latent image formed on the photosensitive member 109 and thereby forms a toner image on this photosensitive member 109. In this embodiment, a two-component development type device is used.

As shown in FIG. 7, for example, this development device 203 is constituted so that a development roller 203*a* which serves as a developer carrier is arranged to be proximate to the photosensitive member 109 and that a development region is formed in a section in which the development roller 203*a* is opposed the photosensitive member 109.

A development sleeve obtained by cylindrically forming a nonmagnetic member made of aluminum, brass, stainless or conductive resin, is rotatably attached to the roller surface of the development roller 203*a*. The development roller 203*a* is constituted to be rotated clockwise by a rotation driving mechanism which is not shown.

A magnet such as a development magnetic pole which forms a magnetic field so as to erect the developer on the surface of this development sleeve, a transport magnetic pole which transports the developer to the development region or from the development region or the like, is fixedly provided in the development sleeve.

Further, the development device 203 has a doctor blade 203*b* which is provided in the transport direction of the developer carried on the development sleeve of the development roller 203*a*, i.e., in the upstream section of the development region in a clockwise direction in FIG. 7 and which restricts the quantity of the developer on the development roller 203*a*.

Furthermore, the development device 203 has mixing screws 203*c* and 203*d* which pump up the developer toward the development roller 203*a* while mixing the developer in a development casing.

[Cleaning Device 204]

The cleaning device 204 is a device which removes residual toner on the photosensitive member 109 after the toner image formed on the photosensitive member 109 is transferred onto a transfer medium, such as a transfer sheet or an OHP sheet, or an intermediate transfer member.

As shown in FIG. 7, for example, this cleaning device 204 includes a cleaning blade 204*a* which scrapes off the residual toner on the photosensitive member 109, and a waste toner transport screw 204*b* which discharges the residual toner thus scraped off by the cleaning blade 204*a* as waste toner into a waste toner container, not shown, which serves as a waste toner storage unit provided outside of the engine units 2C, 2M, 2Y and 2K.

[Toner Supply Unit]

Figure 20:
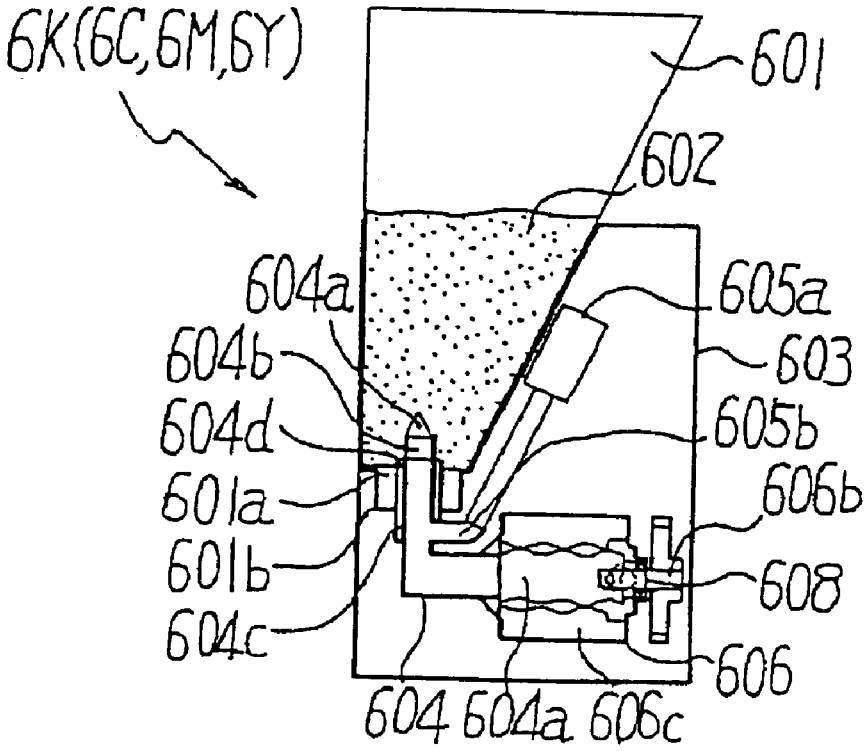
FIG. 20 is a schematic perspective view which shows a toner supply device adopted in the image formation apparatus.
Figure 21:
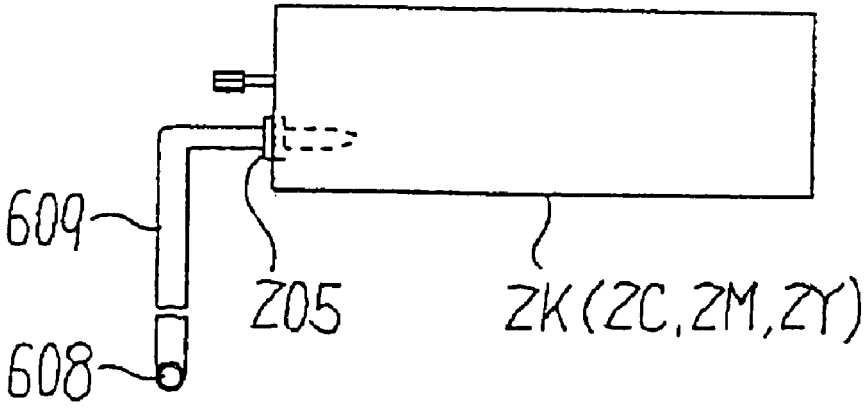
FIG. 21 is a schematic side view which shows the positional relationship between the toner supply device and each engine unit.

Referring next to FIGS. 20 and 21, the toner supply device 6K (6C, 6M or 6Y) employed in the image formation apparatus in this embodiment will be explained.

The image formation apparatus in this embodiment adopts a toner supply mechanism described in JP-A No. 2000-227706. The toner supply device 6K (6C, 6M or 6Y) adopted in the image formation apparatus in this embodiment is a device which supplies toner to the development device 203.

This toner supply device 6K (6C, 6M or 6Y) consists of a toner container 601 shown in FIG. 20, a mechanism which discharges toner from the toner container 601, a pipe 609, shown in FIG. 21, which supplies the toner to the development device 203, a toner transport tube (not shown) which connects the toner discharge section 608 of the toner container 601 to the pipe 609 and the like.

As shown in FIG. 20, the toner container 601 is provided to contain makeup toner 602 and formed into a trapezoid having a narrower width toward a lower section. This toner container 601 has a closed structure and a seal valve, which consists of a valving element 601*a* formed out of an elastic material such as foaming sponge and a fixing member 601*b* fixing the valving element 601*a*, is provided on the bottom of the container 601.

A crisscross penetrating slit is provided in the valving element 601*a* to enable a nozzle 604 to be inserted into the container 601. When the toner is replaced, the toner container 601 including the valving element 601*a* and the fixing member 601*b* is attached and detached, as a toner cartridge, from the image formation apparatus.

Further, the sections of the toner container 601 other than the seal valve are made of paper, thereby making it possible to reduce recovery and distribution cost by folding the toner container 601 after being used. The toner container 601 is constituted to be replaceable from above by opening a door (not shown) provided on the upper section of the image formation apparatus.

The toner container 601 is set on a support frame 603. While this toner container 601 is being set thereon, one end of the nozzle 604 is inserted into the toner container 601 and the protruding section 604*a*, air inlet 604*d* and toner discharge port 604*b* of the nozzle 604 are protruded to the upper section of the valving member 601*a*.

On the other hand, the other end of the nozzle 604 is connected to the suction port of a uniaxial, eccentric screw pump 606. This screw pump 606 includes a hard rotor 606*a* formed into an eccentric screw shape, and a stator 606*c* which is made of an elastic member of rubber or the like, formed into a twin bar screw shape and fixedly disposed. The rotor 606*a* is driven to rotate through a driving shaft 606*b* which receives a driving force from a motor (not shown) and rotates.

In addition, an air pump 605*a* is connected to an air path through an air connection port 605*b*.

The toner supply device 6 constituted as explained above supplies toner as follows. Based on a permeability detector (not shown) provided at a part of the development device 603, a change in a mixing ratio of toner to carrier is first detected. If it is determined that it is necessary to supply toner, the air contained in the air pump 605*a* is fed into the toner container 601 from the air inlet 604*d* through the air connection port 605*b* and the air path 604*c*. At this moment, the rotor 606*a* in the uniaxial eccentric screw pump 606 starts rotating simultaneously and a strong self-priming force is thereby generated in the uniaxial eccentric screw pump 606.

The toner in the toner container 601 which is fluidized by the air flow fed from the air pump 605*a* is then discharged to the outside of the toner container 601 through the toner discharge port 604*b* by the air pressure, the suction force of the uniaxial eccentric screw pump 606 or the like. Thereafter, the toner is attracted toward the uniaxial eccentric screw pump 606 and fed to the pipe 609 and the development device 203 through the discharge port 608 and the toner transport tube (not shown). At this moment, as shown in FIG. 21, an air filter is provided on a part of the pipe 609 so that only the air in the mixture gas of the toner and air flow is exhausted from the pipe 609 to prevent the toner from splashing off from the development device 203.

The uniaxial eccentric screw pump 606 employed in the toner supply device 6K (6C, 6M or 6Y) in this embodiment is capable of continuously, constantly supplying the toner with a high solid-to-gas ratio to thereby obtain an accurate toner supply quantity proportional to the number of revolution of the driving shaft 606*b*. It is, therefore, possible to easily, accurately control the toner supply quantity by controlling screw pump driving time.

On the other hand, as will be explained later, the lives of the photosensitive member 109 and the carrier of each of the engine units 2C, 2M, 2Y and 2K in this embodiment which have been conventionally short are lengthened. The life of each of the engine unit 2C, 2M, 2Y and 2K can be, therefore, lengthened as a whole and running cost can be reduced.

Furthermore, since each of the engine units 2C, 2M, 2Y and 2K is fixed to the image formation apparatus using a screw 11*b* to be explained later, each manufacturer can ensure recovering the engine units 2C, 2M, 2Y and 2K. Thus, the image formation apparatus in this embodiment can advantageously guarantee quality in the sense that it is possible to decrease load on the environment and to improve positional accuracy.

The above explanation relates to the sections common to the engine units 2*a* and 2*b*.

B. Section different between the engine units 2*a* and 2*b* so that the engine units 2*a* and 2*b* have different recording speeds and resolutions

[Optical Scanning Device 100]

Figure 1:
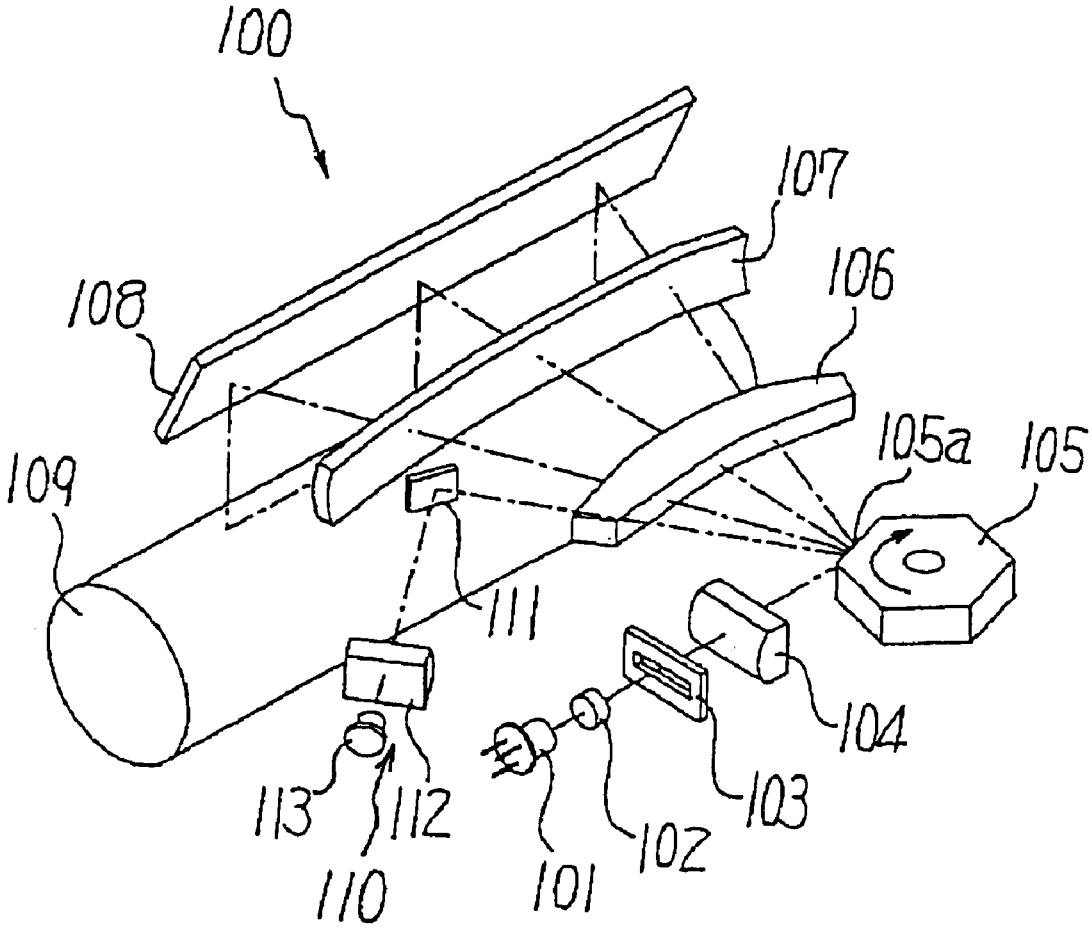
FIG. 1 is a schematic perspective view which shows an optical scanning device in one embodiment according to the present invention.

An example of the schematic configuration of this optical scanning device 100 will first be explained with reference to FIG. 1. FIG. 1 is a schematic perspective view of the optical scanning device 100 in this embodiment. Light applied from the light source such as the semiconductor laser 101 is transformed into a parallel beam by a coupling lens 102, restricted to have a predetermined beam diameter by an aperture diaphragm 103 and shaped to converge in a sub-scanning direction by a cylindrical lens 104 and incident on one reflecting surface 105*a* of a polygon mirror 105 which serves as a deflector. The light beam incident on the reflecting surface 105*a* is subjected to deflecting scanning in a main scanning direction following the rotation of the polygon mirror 105 which rotates at high speed. The light beam reflected by the reflecting surface 105*a* of the polygon mirror 105 and subjected to deflecting scanning passes through imaging elements 106 and 107 which constitute a two-stage fθ lens structure, and through a folded mirror 108, whereby an image is formed, as a micro-light spot on the drum-shaped photosensitive member 109 which serves as an image carrier. At this moment, a light spot radiation position is moved to the main scanning direction following the deflecting scanning, whereby the light beam is scanned at constant speed. Accordingly, an exposure unit (writing unit) is constituted by scanning optical system which consists of the semiconductor laser 101, the coupling lens 102, the aperture diaphragm 103, the cylindrical lens 104, the polygon mirror 105, the imaging elements 106 and 107 and the folded mirror 108.

Reference symbol 110 denotes a synchronous detection system which detects the lighting start timing of the semiconductor laser 101 in respect of the light beam to be scanned on the photosensitive member 109. The synchronous detection system 110 consists of a synchronous detection sensor 111, a folded mirror 112 and an imaging lens 113.

While the engine units 2*a* and 2*b* in this embodiment are common in that each unit is an optical system constituted as explained above, they differ in performance, i.e., resolution. As a result, the engine units 2*a* and 2*b* have different beam spot diameters. To change the beam spot diameter, it is necessary to optimize the configurations of the semiconductor laser 101, the coupling lens 102, the aperture diaphragm 103, the cylindrical lens 104, the polygon mirror 105, the imaging elements 106 and 107, the folded mirror 108 and the like.

Specifically, if the engine units 2*a* and 2*b* are compared with each other, it is found that the aperture diaphragm 103 of the engine unit 2*a* is narrower than that of the engine unit 2*b* and that the beam diameter of the engine unit 2*a* is smaller than that of the engine unit 2*b*. In addition, the shapes of the cylindrical lens and the fθ lenses are adjusted by one of various well-known methods so that the engine unit 2*a* can form a beam spot having a smaller beam diameter than that of the beam spot which the engine unit 2*b* forms, on the photosensitive member.

The configuration of the image formation apparatus main body to which engine units having different resolutions can be attached, will next be explained.

If an engine unit has different resolutions, the number of pixels changes. It is, therefore, necessary to change the image formation apparatus main body to which an engine unit having high resolution is attached, to have an appropriate configuration so that the light scanning device can scan more pixels or more pixels can be transmitted from an image processing section to the light scanning device. In other words, the image processing capability and image transmission capability of the image formation apparatus main body matter.

The easiest example of the configurations of the image formation apparatus main body among these configurations of the image formation apparatus main body is such that the transmission capability of an image information transmission path provided on the image formation apparatus main body and the image processing capability of the main body are determined in accordance with the engine unit, among the engine units attachable to the main body, that forms an image in conditions of the heaviest processing load. According to this configuration, even if an engine unit having heavy processing load is attached to the image formation apparatus main body, it is possible to process and transmit an image. In addition, according to this configuration, if an engine unit having light processing load is attached to the image formation apparatus main body, it is possible to perform processings simply with a margin left. To improve the image processing capability and the image transmission capability, the CPU is improved. If the CPU is improved, cost is pushed up; however, by providing a common image formation apparatus main body, it is possible to advantageously reduce production cost.

As another example of the configuration of the image formation apparatus main body, the image formation apparatus main body is constituted so that image formation speed is decreased if an engine unit having heavy processing load is attached to the main body, making it possible to deal with such an engine unit even if the main body does not leave a margin for the image processing capability and the image transmission capability.

Among these various configurations, one of the preferred embodiments will be shown below. The image formation apparatus main body in this embodiment is constituted so that the controller 5 can control the transmission quantity of image information in accordance with the resolution and the number of gradations of each of the engine units 2*a*, 2*b*, . . . which may probably be attached to the main body.

Specifically, the image formation apparatus main body in this embodiment includes a page memory which compresses image information acquired from the scanner or the network using a well-known compression unit such as JPEG and which stores the compressed image information for each page. If an image is to be formed, the image information obtained by extending the compressed image stored in the page memory is subjected to an image processing such as a half tone processing by the image processing section, converted into information which the optical scanning device 100 can process and then transmitted to the optical scanning device 100 through a transmission path such as a PCI bus.

According to such an image processing method, the number of pixels extended in fixed time cannot be set constant if variable-length compression is employed to extend compressed image information. As a result, the predetermined number of pixels cannot be disadvantageously transmitted to the optical scanning device 100 in predetermined time. To overcome this disadvantage, in this embodiment, a line memory is provided on the optical scanning device 100 side transmission path which connects the image processing apparatus to the light scanning device 100. This line memory has a sufficient capacity for the light scanning device 100 to perform scanning in predetermined time even if an engine unit having heavy processing burden is attached to the image formation apparatus main body. For example, if the number of gradations per pixel of the engine unit 2*a* which forms an image at a speed of 1200 dpi is 2 (1 bit) and the number of gradations per pixel of the engine unit 2*b* which forms an image at a speed of 600 dpi is 3 (2 bits), the quantity of information necessary to write a string of image information is twice as large as that of the engine unit 2*b* on the engine unit 2*a*. The line memory on the light scanning device 100 side has, therefore, a capacity sufficient to process the image information of the engine unit 2*a*. It is assumed herein that the capacity of the line memory is as much as 20 strings of image information.

The controller 5 controls the image formation apparatus main body to extend the image information from the page memory and feed the extended image information to the line memory while monitoring the capacity of the line memory. If the engine unit 2*a* is attached to the image formation apparatus main body, the controller 5 controls the main body so that the capacity of the line memory has up to a predetermined rate A. If the engine unit 2*b* is attached thereto, the controller 5 controls the main body so that the capacity of the line memory has up to a rate A/2 which half of the rate A. By doing so, the line memory is controlled to always store 20 strings of image information irrespectively of the types of the engine unit (2*a* or 2*b*), making it unnecessary to change the other control algorithm.

In this embodiment, the line memory which is originally capable of storing 40 strings of image information, stores only 20 strings of image information if the engine unit 2*b* is attached to the image formation apparatus main body, which means that the memory has surplus capacity. However, because of the advantage in cost reduction obtained by using a common image formation apparatus main body, the disadvantage of the surplus capacity of the memory in respect of cost becomes smaller as a whole or rather turns an advantage.

In the meantime, as resolution is higher, a requirement for the positional accuracy between the light scanning device and the photosensitive member becomes stricter. In this embodiment, therefore, it is also preferable that the light scanning device 100 is formed integrally with the other image formation units including the photosensitive member 109 into one unit.

Figure 2A:
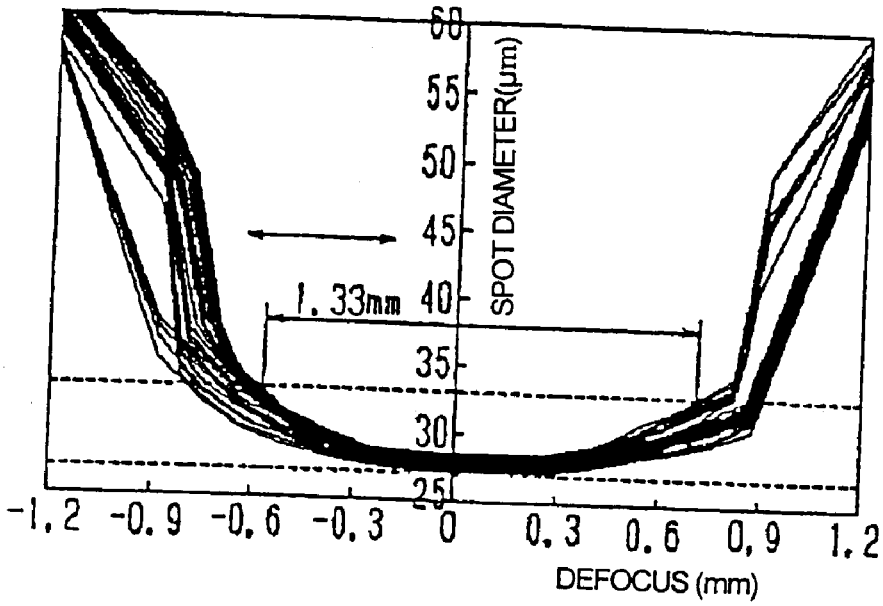
FIGS. 2A and 2B are graphs which show a manner of a beam diameter change according to a change in beam depth direction if the spot diameter of a light beam is narrowed down to about 30 $\mu$m.
Figure 2B:
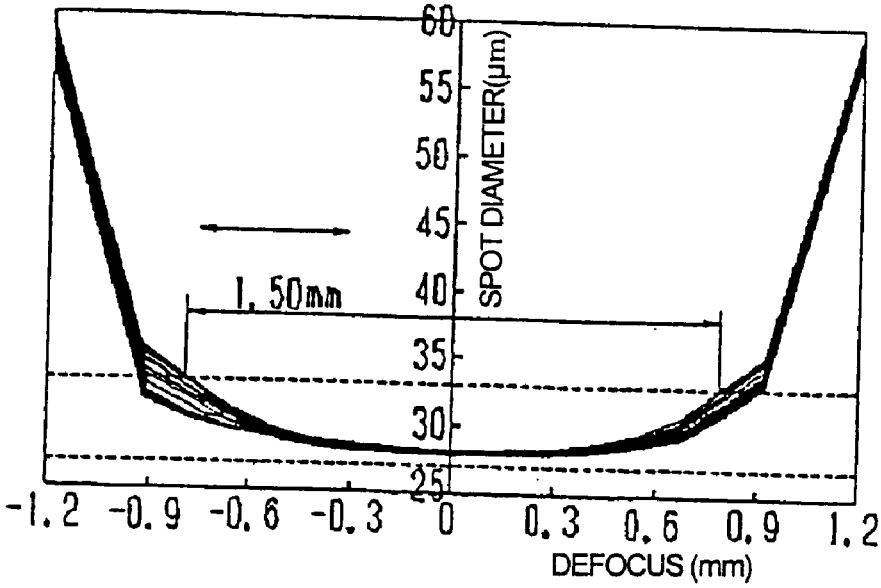

FIG. 2 shows an example of a change in beam diameter following a change in beam depth direction (in which the beam penetrates the photosensitive member 109) if the spot diameter of a light beam scanned on the photosensitive member 109 is narrowed down to about 30 $\mu$m. Namely, FIG. 2 shows "a spot diameter to depth curve" for each image height of the light spot. Specifically, a total of 19 image heights obtained by dividing ±148.5 mm equidistantly. FIG. 2A shows a curve in respect of the main scanning direction and FIG. 2B shows a curve in respect the sub-scanning direction.

If the specification of the beam spot diameter required by the scanning optical system (which is a spot diameter on the photosensitive member 109 expressed by an intensity $1/e^2$ of a line spread function) is 30 $\mu$m±3 $\mu$m, the depth margin of the beam spot diameter is as small as about 1.5 mm according to FIG. 2A and FIG. 2B.

The position of the beam waist of the beam spot diameter on the photosensitive member 109 is shifted toward the polygon mirror 105 side or the opposite side thereto (arrow ⇆ direction shown in FIG. 2A and FIG. 2B) due to the processing tolerances of the optical components and the holding members of the optical components of the scanning optical system. As a result, the beam spot diameter widens. Actually, the arrangement error of the photosensitive member 109 is added, thereby further widening the beam spot diameter. Consequently, it is impossible to satisfy the required specification of the beam spot diameter.

Figure 3:
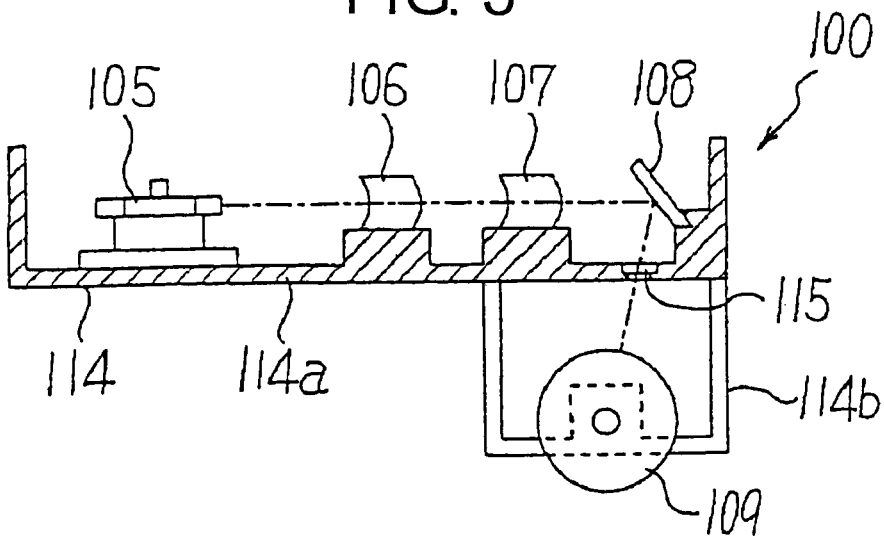
FIG. 3 is a longitudinal side view which shows the characteristic configuration of this embodiment.

Considering this, in this embodiment, as shown in FIG. 3, the constituent members of the light scanning device 100, i.e., the scanning optical system which consists of the semiconductor laser 101, the coupling lens 102, the aperture diaphragm 103, the cylindrical lens 104, the polygon mirror 105, the imaging elements 106 and 107 and the folded mirror 108, and the photosensitive member 109 are held in the same housing 114, i.e., an assemble structure is provided. Reference symbol 115 denotes a dustproof glass. In other word, the housing 114 has a scanning optical system holding section 114*a* which holds the scanning optical system which consists of the semiconductor laser 101 to the folded mirror 108 and a photosensitive member holding section 114*b* which holds the photosensitive member 109 and which is located at a position in a predetermined positional relationship with the scanning optical system. The photosensitive member 109 is held integrally on the front side and the depth side of the photosensitive member holding section 114*b* in FIG. 3 and positioned.

Figure 24:
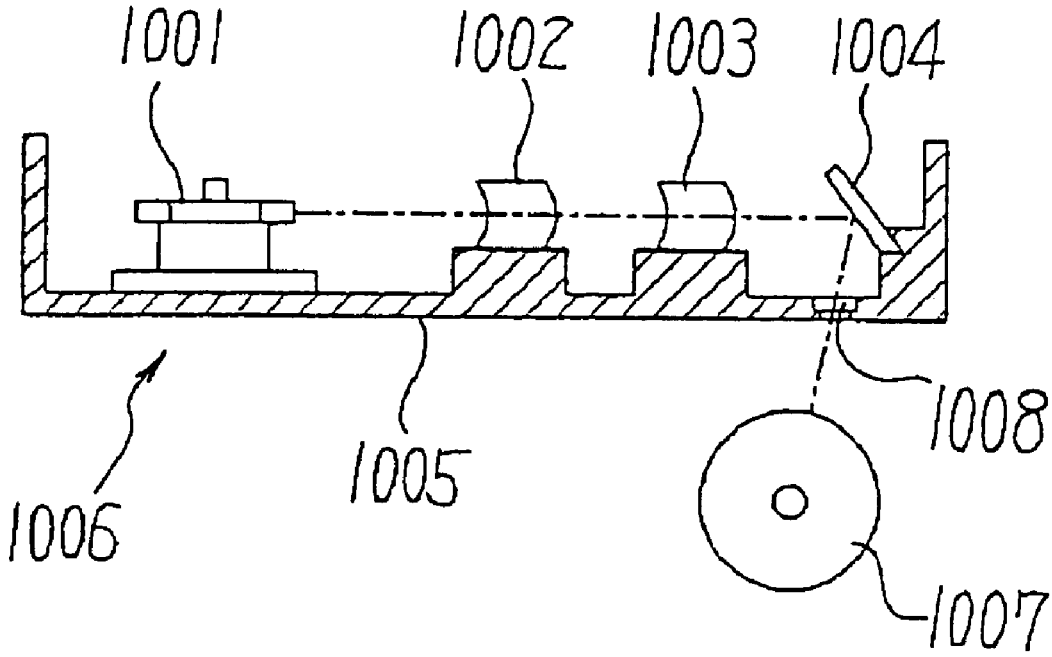
Figure 25:
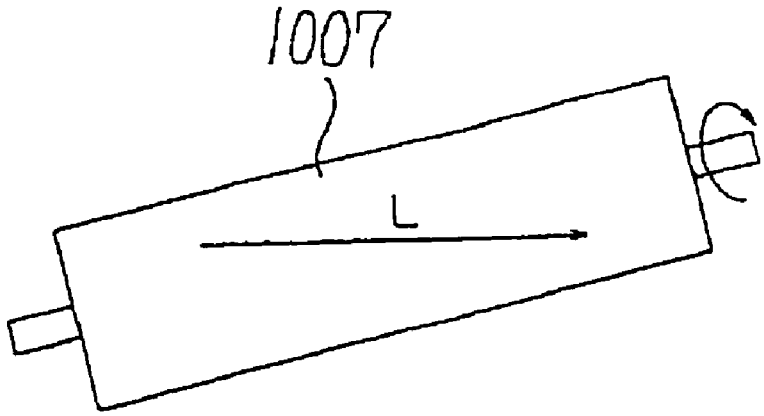
FIG. 25 is a front view of a photosensitive member.

According to the configuration of this embodiment, since the processing error of the assembly section for the respective members formed integrally is as small as about ±10.05%, it is possible to make the arrangement error between each optical component and the photosensitive member 109 about 1/10 as small as that in the conventional apparatus shown in FIG. 24 and the like. It is, therefore, possible to set the beam spot diameter on the photosensitive member 109 to fall within the required specification. Further, since the scanning optical system and the photosensitive member 109 are held in the same housing 114, the scanning optical system is not inclined with respect to the photosensitive member 109 as seen in FIG. 25, making it possible to prevent image degradation.

It is now assumed that as the density of the scanning optical system is higher, the beam spot diameter is narrower and the depth of the beam spot diameter is smaller, with the result that the processing capabilities of the optical components cannot satisfy the tolerances of the desired specifications. In this instance, to satisfy the desired specification of the beam spot diameter, it is necessary to contain the constituent elements (optical components) of the scanning optical system in one housing, to adjust the arrangement positions of the optical components and to thereby absorb a processing error.

Figure 4:
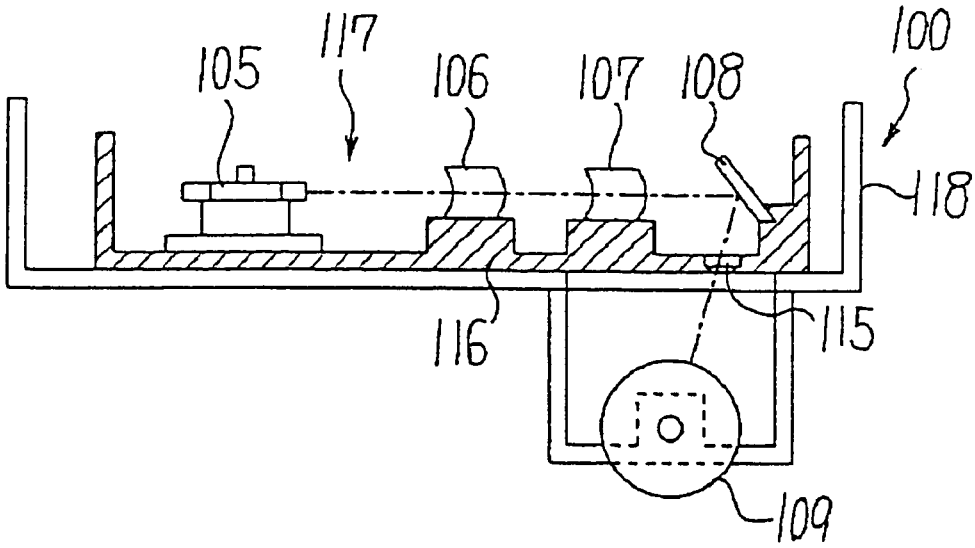
FIG. 4 is a longitudinal side view which shows the different characteristic configuration of the optical scanning device.

To this end, therefore, as shown in FIG. 4, the optical components of the scanning optical system (semiconductor laser 101 to folded mirror 108) are held in one housing 116, thereby constituting the optical components as an optical scanning unit 117 and holding this optical scanning unit 117 and the photosensitive member 109 in the same housing 118. In the optical scanning unit 117, the positions of the optical components (semiconductor laser 101 to folded mirror 108) are made adjustable.

According to the configuration shown in FIG. 4, the optical scanning unit 117 and the photosensitive member 109 are separately constituted. Compared with the integral configuration shown in FIG. 3, therefore, processing errors are accumulated in the configuration shown in FIG. 4. However, since the positions of the optical components (semiconductor laser 101 to folded mirror 108) are adjustable and the processing errors of the respective optical components and the holding sections thereof can be absorbed by adjusting the positions thereof, the depth margin in the configuration shown in FIG. 4 can substantially satisfy the required beam diameter specification more easily.

Figure 5:
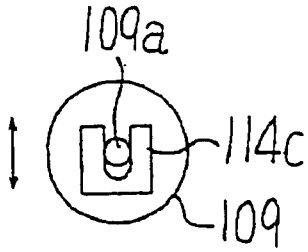
FIG. 5 is a side view which extracts and shows only the different characteristic constituent section of the optical scanning device.

Further, if it is assumed that the depth margin exceeds a depth range which can satisfy the specification of the beam spot diameter, as shown in FIG. 5, the photosensitive member 109 which serves as an image carrier is assembled with the housing 114 (or 118) so as to make the assembly position adjustable and adjust the arrangement position of this photosensitive member 109 to satisfy the specification of the beam spot.

That is to say, the shaft 109*a* on the both ends of the photosensitive member 109 is held to be position adjustable or position fixable in the direction in which the distance between the shaft 109*a* and the folded mirror 108 side can be adjusted by a bracket 114*c* which is formed on a part of the housing 114 (or 118).

According to the configuration shown in FIG. 5, therefore, even if the processing capability of processing the housing 114 (or 118) is insufficient or the tolerances of the respective components exceed the accumulated depth margin, it is possible to satisfy the required specification by adjusting the assembly position of the photosensitive member 109.

[Photosensitive Member 109]

The photosensitive member 109 in this embodiment will first be explained.

To lengthen the life of each engine unit, it is necessary to reduce the quantity of scraped-off film of the photosensitive member. To do so, a photosensitive member provided with a surface layer which suppress the film of the photosensitive member from being scraped off, is used in each of the engine units 2*a* and 2*b*.

Figure 8:
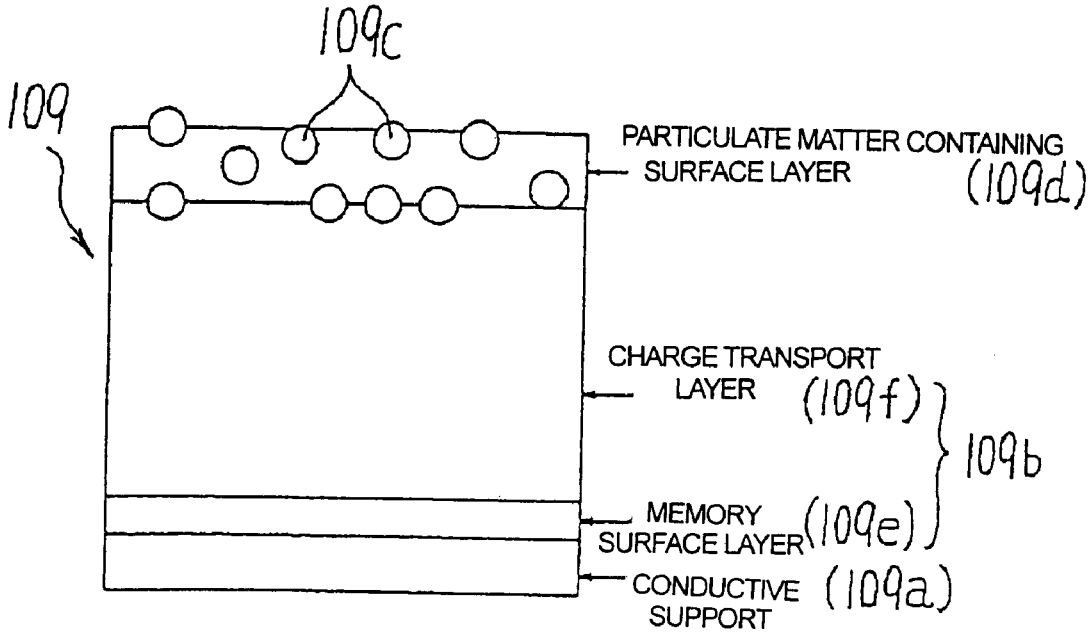
FIG. 8 is a schematic, enlarged cross-sectional view which explains one example of a photosensitive member integral with the engine unit.

Specifically, the photosensitive member 109 used in each of the engine units 2*a* and 2*b* is a photosensitive member which includes a photosensitive layer on a conductive substrate. As shown in FIG. 8, the photosensitive member 109 has a multilayer structure in which a photosensitive member including a conductive support 109*a* and a photosensitive layer 109*b* which consists of a charge generation matter and a charge transport matter is provided and a particulate matter containing surface layer 109*d* containing a particulate matter 109*c* is further provided on the photosensitive member.

Since the engine unit 2*a* performs an image formation operation in larger quantities than the engine unit 2*b*, it is necessary to adjust not only the process speed of the photosensitive member 109 but also the difference in abrasion caused by the difference in image formation quantity. Therefore, the photosensitive member 109 of the engine unit 2*a* has a thicker particulate matter containing surface layer than that of the photosensitive member 109 of the engine unit 2*b*.

In addition, since the engine unit 2*a* performs an image formation operation at higher speed than the engine unit 2*b*, it is necessary that the photosensitive member 109 of the engine unit 2*a* forms a latent image with sufficient electrical contrast for a time period from the image information writing position by the optical scanning device 100 until the arrival of the development device at one point on the photosensitive member 109. This period becomes longer as the distance from the charge generation layer to the surface of the photosensitive member is longer. In this embodiment, therefore, the photosensitive members 109 are constituted so that the sum of the film thickness of the photosensitive layer and that of the particulate matter containing surface layer of the engine unit 2*a* is smaller than the film thickness of the surface layer of the engine unit 2*b*.

The detailed configuration of the photosensitive member 109 including the film thickness thereof will next be explained.

Since ordinary matters can be used for the layers other than the particulate matter containing surface layer 109*d*, these layers will not be explained herein in detail. In this embodiment, the photosensitive layer formed by sequentially superimposing, on a conductive substrate, a charge generation layer which contains a charge generation matter and which has a film thickness of about 0.01 to 5 μm, and a charge transport layer which is formed by melting and coating resin on a low molecular charge transport matter and a binder, serving as a charge transport material, and which has a thickness of about 5 to 100 μm.

More specifically, in the engine unit 2*a*, the photosensitive member 109 is constituted by sequentially superimposing the charge generation layer having a film thickness of 3 μm and the charge transport layer having a film thickness of 30 μm on the conductive substrate and further superimposing the particulate matter containing surface layer 109*d* having a film thickness of 4 μm on the resultant layers. In the engine unit 2*b*, the photosensitive member 109 is constituted by sequentially superimposing the charge generation layer having a film thickness of 3 μm and the charge transport layer having a film thickness of 50 μm on the conductive substrate and further superimposing the particulate matter containing surface layer 109*d* having a film thickness of 3 μm on the resultant layers.

As can be seen, in this embodiment, each of the engine units 2*a* and 2*b* includes the particulate matter containing surface layer and the particulate matter suppresses the abrasion of the photosensitive member. The photosensitive member is, therefore, less worn by scraping off the surface thereof with a cleaning blade or the like. The engine units 2*a* and 2*b* are, therefore, suitable for the formation of images in large quantities.

Furthermore, the particulate matter containing surface layer of the engine unit 2*a*, particularly, has a large film thickness, thereby dealing with the formation of images in large quantities.

Moreover, the distance from the charge generation layer to the surface of the photosensitive member is 37 μm in the engine unit 2*a* and 56 μm in the engine unit 2*b*. As a result of the difference in distance between the engine units 2*a* and 2*b*, the engine unit 2*a* takes shorter timer to form a latent image with sufficient electrical contrast. The engine unit 2*a* is, therefore, capable of dealing with fast recording speed compared with the engine unit 2*b*.

As the charge generation matter, inorganic materials such as crystal selenium, amorphous selenium, selenium-tellurium, selenium-tellurium-halogen, selenium-arsenic compound and amorphous silicon, organic materials such as phthalocyanine-based pigment, azulenium salt pigment, stearic acid methine pigment and azo pigment and the like are available.

As the binder resin of the charge transport layer 109*f*, polycarbonate (bisphenol A type, bisphenol Z type, bisphenol C type and copolymers thereof), methacrylic resin and the like, for example, are available. These binder resins can be employed solely or as mixture of two or more resins. As the low molecular charge transport matter of the charge transport layer 109*f*, oxazole derivative, oxadiazole derivative and the like, for example, are available.

The particulate matter containing surface layer 109*d* will be explained hereinafter in detail.

[Composition of Particulate Matter Containing Surface Layer 109*d*]

The content of the particulate matter 109*c* in the particulate matter containing surface layer 109*d* needs to be 5 to 50 wt %, preferably 10 to 40 wt %. That is, the study of the applicant of the present application shows that if the content of the particulate matter 109*c* is not more than 5 wt %, the effect of the abrasion resistance for the photosensitive member 109 is hardly generated and that if the content thereof is not less than 10 wt %, sufficient abrasion resistance effect is obtained. In addition, the study shows that if the content of the particulate matter 109*c* is not less than 40 wt %, image degradation such as greasing due to the opaque film occurs and if the content thereof is not less than 50 wt %, the transparency of the photosensitive member is deteriorated.

[Particulate Matter 109*c*]

This particulate matter is a matter which is contained in the surface layer so as to prevent the abrasion of the photosensitive member 109 and lengthen the life of the photosensitive member 109.

The mean particle diameter of this particulate matter 109*c* is preferably 0.05 to 1.0 μm. If the mean particle diameter is less than 0.05 μm, sufficient abrasion resistance effect cannot be obtained. If the mean particle diameter is larger than 1.0 μm, part of the particle matter protrudes to the surface of the photosensitive member and damages the cleaning blade 204*a* of the cleaning device 204, which causes cleaning defect.

Further, as this particulate matter 109*c*, any particulate matters harder than the resin which constitutes the surface layer of the photosensitive member 109 are available, i.e., inorganic matters and organic matters are all available. They are exemplified by metal oxides such as titanium oxide, silica, tin oxide, alumina, zirconium oxide, indium oxide, silicon nitride, calcium oxide, zinc oxide and barium sulfate. They may be subjected to a surface treatment using an inorganic matter or an organic matter in view of improving dispersibility. For example, as a water repellent treatment, a treatment using a silane coupling agent, that using a fluorine-based silane coupling agent, that using a higher fatty acid or the like can be conducted. As an inorganic treatment, a treatment to a filler surface using alumina, zirconia, tin oxide, or silica can be conducted.

[Binder Resin]

As the binder resin of the particulate matter containing surface layer 109*d*, thermoplastic resins and thermosetting resins are available.

The binder resin may be exemplified by acrylic resin, polyester, polycarbonate, polyamide, polyurethane, polystyrene, epoxy resin or the like.

Further, since the particulate matter containing surface layer 109*d* has a charge transport function, it is a significant condition that the binder resin has good compatibility with a low molecular charge transport material to be explained later.

To allot the charge transport function to the particulate matter containing surface layer 109*d*, a low molecular charge transport matter can be also added to the particulate matter containing surface layer 109*d*. As the low molecular charge transport material to be added, a donor matter having a positive charge carrier transport function and an acceptor matter having a negative charge carrier transport function are available. The low molecular charge transport matter in the negatively charged photosensitive member may be exemplified by oxazole derivative, oxadiazole derivative, imidazole derivative, triphenylamine derivative, 9-(p-diethylamino styryl anthracene), 1,1-bis-(4-dibenzyl amino phenyl) propane, styryl anthracene, styryl pyrazoline, phenylhydrazone, a-phenyl stilbene derivative, thiazole derivative, triazole derivative, phenazine derivative, acridine derivative, benzofuran derivative, benzimidazol derivative or thiophene derivative.

These low molecular charge transport matters can be used solely or as mixture of two or more. In addition, the rate of the content (D) of the low molecular charge transport matter, the content (R) of the binder resin and the content (F) of the particulate matter in the particulate matter containing layer 109*d* preferably satisfies D:R:F=10 to 40:35 to 55:5 to 40 wt %.

That is, if the content of the low molecular charge transport matter is not more than 10 wt %, the rise of potential of a bright section which is considered to be derived from charge mobility occurs. If the content thereof is not less than 40 wt %, the decrease of film strength occurs. In addition, the binder resin is intended to fix the low molecular charge transport matter and the particulate matter. The content of the binder resin of not more than 35 wt % is not preferable in view of a generation of abrasion of the particulate matter containing surface layer 109*d*, and the content of the binder resin of not less than 55 wt % is not preferable in view of the balance between the content of the low molecular charge transport matter and that of the particulate matter, electrical characteristic and film strength. Furthermore, the content of the particulate matter of not more than 5 wt % is not preferable in view of the abrasion resistance of the particulate matter containing surface layer 109*d*. If the content thereof is not less than 40 wt %, image degradation such as greasing due to the opaque film occurs.

[High Molecular Charge Transport Matter]

It is also desirable that the particulate matter containing surface layer 109*d* contains a high molecular charge transport matter. This high molecular charge transport matter which is a carbonate-bonded matter, has good film characteristic and a charge transport function. By using this high molecular charge transport matter, therefore, it becomes unnecessary to add a low molecular charge transport matter or inert binder resin to the surface layer 109*d*. Alternatively, the low molecular charge transport matter or inert binder resin may be added thereto if necessary.

[Formation Method for Particulate Matter Containing Surface Layer 109*d*]

The particulate matte containing surface layer can be formed by applying a ground, dispersed particulate matter 109*c* as well as the binder resin, the low molecular charge transport matter, the high molecular charge transport matter and/or the like to the surface of the charge transport layer 109*f* or the charge generation layer 109*e*.

More specifically, as a dispersion medium for the binder resin, the low molecular charge transport matter, the high molecular charge transport matter and the particulate matter 109*c*, ketone such as methyl ethyl ketone, acetone, methyl isobutyl ketone or cyclohexanone, ether such as dioxane, tetrahydrofuran or ethyl cellosolve, an aromatic compound such as toluene or xylene, halogen such as chlorobenzene or dichlormethane, ester such as ethyl acetate or butyl acetate is used and the particulate matter 109*c* is dispersed and ground using a ball mill, a sand mill, a vibrating mill or the like.

As explained above, the content of the particulate matter 109*c* is 0.5 to 50 wt %, preferably 5 to 40 wt %. In addition, the particle diameter of the particulate matter 109*c* is 0.05 to 1.0 μm, preferably 0.05 to 0.8 μm. The film thickness of the surface layer formed by laminating particulate matter added layers is 0.5 to 10 μm, preferably 0.5 to 5 μm.

As a coating method, an immersion method, a spray coating method, a ring coating method, a roll coating method, a gravure coating method, a nozzle coating method, a screen printing method or the like can be employed.

If a particulate matter layer is provided on a low molecular charge transport layer which consists of the low molecular charge transport matter and the binder resin, it is preferable that the binder resin used in the low molecular charge transport layer differs from that in the particulate matter layer. If so, an interface is formed between the particulate matter layer and the low molecular charge transport layer, thereby preventing the particulate matter 109*c* from being diffused into the low molecular charge transport layer and stabilizing the electrical characteristic of the low molecular charge transport layer.

Further, even if the binder resin used in the low molecular charge transport layer and that used in the particulate matter layer are of the same structure, the layers can be made different in solubility by making the structures of the used low molecular charge transport matters different. By forming the interface between the particulate matter layer and the low molecular charge transport matter, it is possible to stabilize the electrical characteristic of the low molecular charge transport layer, to uniformly distribute the particulate matter 109*c* in the layers, and to improve durability, sensitivity and stability of the photosensitive member 109.

Since the photosensitive member 109 explained above has the particulate matter containing surface layer 109*d* formed on the surface thereof, the surface of the photosensitive member 109 is protected from a physical impact applied by the cleaning blade or the like and the photosensitive member 109 has a longer life than that of a photosensitive member which does not include such a particulate matter containing surface layer 109*d*.

If matters such as ions generated by the discharge of the charging device 202 are kept attached to the surface of the photosensitive member of this type, an image fades in color. To prevent this, it is necessary to scrape off the surface of the photosensitive member to some extent by the cleaning blade and to refresh the surface thereof.

The photosensitive member 109 in this embodiment is formed so that the surface layer is gradually scraped off by the cleaning blade. As a result of the scrape-off of the surface layer of the photosensitive member 109, i.e., the particulate matter containing surface layer 109*d*, the particulate matter 109*c* in this particulate matter containing surface layer 109*d* is somewhat exposed and then spontaneously scraped offs. As a result, a new particulate matter containing surface layer 109*d* is exposed to the surface of the photosensitive member 109, whereby the effect of lengthening the life of the photosensitive member 109 and that of refreshing thereof can be simultaneously attained.

The particulate matter containing layer is provided in each of the engine units 2*a* and 2*b* in this embodiment. However, if the charge transport layer or the like has sufficient abrasion resistance, the particulate matter containing layer may be provided in only one of the engine units 2*a* and 2*b*.

[Developer]

As the developer contained in the development device 203, either a two-component developer obtained by mixing toner with carrier or a one-component developer which does not contain carrier can be used. In this embodiment, the two-component developer is used.

It is conventionally said that the disadvantages of this two-component developer are in that it is difficult to appropriately adjust the rate of toner and that of carrier and developing characteristic deteriorates if the toner adheres to the surface of the carrier (spent toner). If the developing characteristic of the developer deteriorates due to the spent toner, in particular, it is necessary to replace the carrier or the development device 203, preventing the life of the development device 203 from being lengthened.

The engine unit 2*a* performs an image formation operation in larger quantities than the engine unit 2*b*. Therefore, not process speed itself but the deterioration of the carrier caused by the difference in image formation quantity matters for two-component developer.

[Toner]

The toner of the developer is supplied from the outside of the engine units 2C, 2M, 2Y and 2K as will be explained later. It is, therefore, unnecessary that the toner is durable throughout the use of the engine units 2C, 2M, 2Y and 2K. Accordingly, in this embodiment, all types of toner suited for two-component development are available.

[Carrier]

In this embodiment, carrier having a coat layer, which consists of a soft segment and a hard segment, provided on the surface of a core made of a magnetic material is used.

As a result of the study of the applicant of the present application, it is found that an elastic, abrasion resistant coat layer is obtained and that this carrier can consequently absorb contact followed by a strong impact on the coat layer caused by the friction between the carrier and the toner or that between the carriers during the mixture of the developer to frictionally charge the developer.

By using the carrier constituted as explained above, therefore, it is possible to suppress spent toner from adhering to the carrier and to prevent the film on the surface of the carrier from being scraped off, whereby the carrier durability conspicuously improves.

The soft segment means a soft phase or a flexible component in the coat layer of the carrier and functions to absorb impact.

The hard segment means a hard phase or a molecule constraining component and functions to reinforce the carrier.

To provide the coat layer which consists of the soft segment and the hard segment, a method of cross-linking thermoplastic resin such as acrylic resin to amino resin or the like, for example, can be mentioned. As the thermoplastic resin used herein, any well-known thermoplastic resin can be used. As the amino resin, guanamine resin or melamine resin can be used.

An example in which the acrylic resin is used as the thermoplastic resin and the guanamine resin is used as the amino resin will be explained in this embodiment.

As the acrylic resin used herein, any acrylic resin can be used. Preferably, resin having Tg of 20 to 100° C., more preferably, 25 to 80° C. is used. That is, if Tg is not more than 20° C., blocking occurs to the resin even at ordinary temperature and shelf life becomes disadvantageously short. If Tg is not less than 100° C., the resin of the coat layer becomes too hard to obtain elasticity. As a result, the carrier cannot absorb impact and does not attain a sufficient improvement.

In addition, by changing the content of the guanamine resin in a range of 20 to 50 wt %, it is possible to regulate the elasticity of the resin of the coat layer. That is, if the content of the guanamine resin is not more than 20 wt %, a sufficient cross-linking reaction is not generated between the guanamine resin and the acrylic resin and abrasion resistance improvement effect cannot be, therefore, obtained. If the content of the guanamine resin is not less than 50 wt %, then the cross-linking reaction between the guanamine resin and the acrylic resin becomes excess, the coat film resin is too hardened and elasticity cannot be, therefore, obtained. As a result, it is impossible to absorb impact and to obtain sufficient improvement effect.

The carrier may contain, as a charging modifier, aromatic sulfuric acid or phosphoric acid. If such a modifier is used, a cross-linking reaction between the guanamine resin and the acrylic resin can be conducted in a satisfactory manner, whereby the carrier exhibits conspicuous charge adjustment effect. As the charging modifier, carbon black or acid catalyst can be used solely or a combination thereof can be used besides those mentioned above.

As the carbon black, any ordinary carbon black used as carrier or toner is available. As the acid catalyst, any acid catalyst having a catalytic action is available. For example, an acid catalyst containing a reactive group such as perfect alkylation type, methylol group type, imino group type or methylol/imino group type can be used. However, the acid catalyst is not limited thereto. It is also possible that carbon black is used as resistance modifier.

If the content of the charging modifier is set at not more than 10 wt % relative to that of the guanamine resin, conspicuous improvement effect can be obtained. In other words, if the content of the charging modifier is not less than 10 wt %, the charging modifier excessively reacts with the guanamine resin and a sufficient cross-linking reaction is not generated between the guanamine resin and the acrylic resin, with the result that sufficient improvement in abrasion resistance effect cannot be obtained.

Further, in carrier manufacturing process, conspicuous improvement effect can be obtained by satisfying these conditions. Specifically, if the charging modifier is contained in the carrier in the carrier manufacturing process, cross-linking reaction with resin is accelerated to make it possible to suppress the occurrence of coagulation in a manufacturing phase, to obtain the less-coagulated carrier, to facilitate melting and grinding and to improve yield. It is noted, however, the content of the charging modifier should be not more than 10 wt % relative to that of the guanamine resin as explained above. If the content of the charging modifier is not less than 10 wt %, the charging modifier excessively reacts with the guanamine resin and a sufficient cross-linking reaction is not generated between the guanamine resin and the acrylic resin, with the result that sufficient abrasion resistance improvement effect cannot be disadvantageously obtained.

Moreover, particles having a primary particle diameter or a secondary particle diameter larger than the thickness of the coat layer of the carrier may be contained in the coat layer. If the carrier is so composed, particles protrude from the coating of the carrier. It is, therefore, possible to lessen contact followed by a strong impact on the coating resin caused by the friction between the carrier and the toner or that between the carriers due to the mixture of the developer to frictionally charge the developer.

As a result, it is possible to prevent spent toner to the carrier and to prevent the film of the coating resin, to which charging occurs, from being scraped off, thereby obtaining conspicuous improvement effect. If the particle diameter is smaller than the thickness of the coat layer, particles are embedded in the coating resin, thereby greatly deteriorating improvement effect. If the particle diameter is ten times as large as the thickness of the coat layer, the contact area between the particles and the coating resin is decreased, with the result that a sufficient bonding force cannot be generated and particles are easily detached.

Further, the content of particles is 20 to 80 wt %, preferably 30 to 70 wt % relative to the coating resin. Namely, if the content of particles is less than 20 wt %, the rate of the particles is lower than the rate of the coating resin in the carrier surface and the sufficient effect of lessening contact followed by a strong impact on the coating resin cannot be, therefore, obtained. If the content of particles is more than 80 wt %, the rate of the particles is too high compared with the rate of the coating resin in the carrier surface and the rate of the coating resin, to which charging occurs, is, therefore, insufficient to obtain sufficient charging capability.

In addition, by using, as particles used herein, alumina, titanium oxide, zinc oxide, barium oxide, ferric oxide, barium sulfate or the like, conspicuous improvement effect can be obtained. However, the particles are not limited thereto.

As the carrier in this embodiment, carrier having the surfaces of particles subjected to a coating treatment by a low electrical resistance matter can be used. Since the surfaces of the particles of this carrier is low in electrical resistance, it is possible to suppress toner from being excessively charged and charges in a contact region is easily moved to the surface of the carrier out of contact, thereby contributing to the improvement of charge exchange characteristic and charging speed. As a result, even if toner or the like is slightly attached to the surface of the carrier, charging quantity is not greatly lowered and conspicuous improvement effect can be obtained.

[Concrete Examples of Carrier]

The carrier in this embodiment preferably satisfies the following conditions. Needless to say, the carrier in this embodiment is not limited to the carrier which satisfies these conditions.

As the carrier in this embodiment, for example, an acrylic resin solution: 167 parts [50 wt % solid (HITALOID3001: Hitachi Chemical Co., Ltd.)], guanamine resin solution: 19 parts [77 wt % solid (MYCOAT106: Mitsui Cytech. KK)], a charging modifier solution: 4.5 parts [40 wt % solid (CATALYST4040: Mitsui Cytech. KK)], toluene: 400 parts, and butyl cellosolve: 400 parts are dispersed for 10 minutes by a Homomixer® to prepare a resin coat formation solution. In addition, burned ferrite powder [F-300: mean particle diameter: 50 $\mu$m (Powdertech Co., Ltd.)] is used as a core and the resin solution is coated on the surface of the core by a film thickness of 0.15 $\mu$m by a SPIRA COTA® (OKADA SEIKI CO., LTD.) and dried. The carrier thus obtained is left in an electric furnace at 150° C. for 1 hour and burned. After cooling, the carrier is ground using a screen of a mesh size of 100 $\mu$m to thereby obtain carrier.

[Another Example of Carrier]

As the coat layer which consists of the soft segment and the hard segment, coating resin generated from an organic compound (A) containing a functional group (except for Si ($OR^1$) group (where $R^1$ is a hydrogen atom, a lower alkyl group or an acyl group)), a compound (B) containing a functional group and an Si ($OR^1$) group which can react with the functional group contained in the organic compound (A) (where $R^1$ is the same as above) and/or an organic silicon compound (C) expressed by the following ordinary formula and/or hydrolysis condensate thereof may be used. In this instance, the compound (A) functions as the soft segment, the compound (C) functions as the hard segment and the compound (B) functions as the binder.

$$Si(OR^2)_4$$

(In this ordinary formula, $R^2$ may be either the same or different and indicates a hydrogen atom, a lower alkyl group or an acyl group).

In this embodiment, the highly durable carrier explained above is used in each of the engine units 2*a* and 2*b*. The content of the guanamine resin is set at 40 wt % in the engine unit 2*a* and set at 30 wt % in the engine unit 2*b*, whereby the engine unit 2*a* has higher durability.

The section different between the engine units 2*a* and 2*b* so as to change performances related to recording speed and resolution has been thus explained.

[Operation of Engine Units 2C, 2M, 2Y and 2K]

The operation of each of the engine units 2C, 2M, 2Y and 2K will next be explained.

In FIGS. 6 and 7, the photosensitive member 109 continues to rotate counterclockwise during image formation. A predetermined bias is applied first to the charging device 202 from the light source (not shown). As a result, the surface of the photosensitive member 109 is uniformly, negatively charged with a potential of about −600 [V].

A writing beam is applied from the semiconductor laser of each optical scanning device 100 held in the housing 114 in which the photosensitive member 109 thus charged is held, to the photosensitive member 109. As a result, positive holes are generated in the charge generation layer 109*e* of the photosensitive member 109 and the positive holes thus generated reach the surface of the photosensitive member 109 through the charge transport layer 109*f* and the particulate matter containing surface layer 109*d*.

When the positive holes reach the surface of the photosensitive member 109, the charging potential of each of the sections which the positive holes reach rises to about −100 [V] by the action of the positive holes. As a result, an electrostatic latent image according to the writing beam is formed on the photosensitive member 109. That is, in this embodiment, the electrostatic latent image in the sections of surface of the photosensitive member 109 to which the writing beam is applied, becomes an image section and the other sections become a non-image section.

In the development device 203, the two-component developer is pumped up onto the development roller 203*a* by the rotation of the development sleeve and the action of the transport magnetic pole. The two-component developer thus pumped up onto the development roller 203*a* is transported to the development region which is a section in which the photosensitive member 109 is opposed to the development device 203 while the layer thickness of the developer is restricted by the doctor blade 203*b*.

The carrier which constitutes the developer is erected in the form of a chain on the development sleeve along a magnetic line of force generated from the development magnetic pole in the development roller 203*a*. In addition, the charged toner adheres to the carrier erected in the form of a chain, thereby forming a magnetic brush.

The magnetic brush thus formed is moved in the same direction as that of the development sleeve, i.e., in a clockwise direction following the rotation and movement of the development sleeve.

On the other hand, the two-component developer transported from the development region is mixed again using the mixing screws 203*c* and 203*d* to bring the toner and the carrier contained therein into contact with each other in the casing of the development device 203, thereby appropriately charging the two-component developer.

Since the carrier in this embodiment is provided with the coat layer which consists of the soft segment and the hard segment as already explained above, it is possible to prevent the coat layer from being peeled off by the contact between the carrier and the toner or between carriers.

According to the carrier in this embodiment, therefore, the coat layer of the carrier is less peeled off and the spent toner phenomenon hardly occurs. Accordingly, it is possible to maintain the charging characteristic of the carrier for a long period of time and to lengthen the life of each of the engine units 2C, 2M, 2Y and 2K.

The electrostatic latent image formed as explained above reaches the development region which is a section in which the photosensitive member 109 is opposed to the development device 203, and the erected magnetic brush thereby contacts with the photosensitive member 109.

At this moment, a potential which is the intermediate between the potential of the image section of the electrostatic latent image and the non-image section thereof is applied from the light source (not shown) to the development roller 203*a* of the development device 203. The potential thus applied causes the negatively charged toner contained in the magnetic brush to be attracted toward the image section of the electrostatic latent image and to be separated from the non-image section thereof. As a result, the toner adheres only to the image section of the electrostatic latent image and a toner image is thereby formed.

The voltage applied to the development roller 203*a* may be alternating voltage.

The toner image thus formed is transferred onto the intermediate transfer belt 8 in the contact section between the photosensitive member 109 and the intermediate transfer belt 8. At this moment, the residual toner on the photosensitive member 109 which is left without being transferred onto the intermediate transfer belt 8 is physically scraped off by the cleaning blade 204*a* of the cleaning device 204 which contacts with the photosensitive member 109 at predetermined pressure.

The residual toner scraped off by the cleaning blade 204*a* is separated from the cleaning blade 204*a* and temporarily contained in the casing of the cleaning device 204. Thereafter, by the waste toner transport screw 204*b*, the residual toner temporarily contained in the casing is discharged, as waste toner, into the waste toner container which is provided outside of the engine units 2C, 2M, 2Y and 2K.

Since the photosensitive member 109 in this embodiment has the particulate matter containing surface layer 109*d* provided on the surface thereof, the abrasion degree of the photosensitive member 109 can be adjusted at the time the residual toner is scraped off by the cleaning blade 204*a*. It is, therefore, possible to decrease the abrasion degree of the photosensitive member 109 and to lengthen the life of each of the engine units 2C, 2M, 2Y and 2K.

The image formation operation including charging, exposure and development is common to the engine units 2*a*, 2*b*, . . . . However, since the image formation conditions are controlled in the image formation apparatus main body in this embodiment by reading information stored in the memories 212*a*, 212*b*, . . . in the engine units 2*a*, 2*b*, . . . connected to the main body, respectively, the engine units 2*a*, 2*b*, . . . differ in image formation speed.

[Life-Lengthened Engine Unit]

As explained above, the engine units 2C, 2M, 2Y and 2K in this embodiment are invented to lengthen their lives in various manners. This enables the life of each of the engine units 2C, 2M, 2Y and 2K to be longer than that of the image formation apparatus main body (which corresponds to the sections of the image formation apparatus other than the engine units 2C, 2M, 2Y and 2K and the same shall apply hereinafter) and the rental or use period of the image formation.

Accordingly, it is possible to provide an image formation apparatus which is not at all required to replace the engine units 2C, 2M, 2Y and 2K while being used. It is, therefore, possible to decrease the number of times of replacement operations conducted to replace the respective image formation units in the image formation apparatus and to reduce the running cost of the image formation apparatus, which are great advantages to both the user and the service person.

Meanwhile, the image formation unit in the form of the process cartridge as explained above is required to be regularly replaced by a user. The handling of the image formation unit which becomes unnecessary after the replacement is left to the user. For that reason, it is difficult that the process cartridge is recovered as a waste by the manufacturer or surely recycled, with the result that the problem of the reduction of load, such as resource consumption and environmental pollution, imposed on the natural environment still remains unsolved.

To solve this disadvantage, according to this embodiment, since each of the engine units 2C, 2M, 2Y and 2K has a longer life than that of the image formation apparatus, the regular replacement of the engine units 2C, 2M, 2Y and 2K becomes unnecessary and it becomes unnecessary to make the image formation unit (or engine unit) in the form of the process cartridge easy to replace by the user.

Further, each of the engine units 2C, 2M, 2Y and 2K is constituted to be fixed to the image formation apparatus main body using the tool and only the service person who owns this tool is allowed to attach and detach the engine unit 2C, 2M, 2Y or 2K.

By doing so, unlike the process cartridge, it is possible to ensure that the manufacturer can recover the used engine units 2C, 2M, 2Y and 2K without leaving a disposal or recycle operation to the user.

As a result, it is possible to ensure that the manufacturer can conduct operations to reuse the engine units 2C, 2M, 2Y and 2K as secondhand engine units or to recycle them and to thereby ensure accelerating the reduction of load on the environment. It is desirable that the engine units 2C, 2M, 2Y and 2K which have not been already used can be recovered by the manufacturer.

In addition, by the manufacturer's recovery of the engine units 2C, 2M, 2Y and 2K which have not been already used, it is possible to prevent the respective image formation units (engine units) and the user from being contaminated or damaged due to the erroneous touch of the unfamiliar user to the image formation units such as the photosensitive member 109. It is also possible to guarantee product quality and to reduce burden on the user.

Furthermore, it is significant in respect of the guarantee of quality to make the engine units 2C, 2M, 2Y and 2K attachable and detachable only on the part of the manufacturer. That is, while there is a high probability of the occurrence of a delicate attachment error every time a user attaches the engine units 2C, 2M, 2Y and 2K which are attachable and detachable by the user, it is possible to decrease or eliminate such an error by leaving the attachment and detachment thereof to the manufacturer. If the engine units 2C, 2M, 2Y and 2K are more fixedly attached to the image formation apparatus, it is particularly possible to decrease the frequency of the attachment error, accordingly.

For example, the optical scanning device is originally unsuited for a user to conduct a maintenance operation thereto and fixedly assembled into the image formation apparatus main body. In this embodiment, the optical scanning device 100 is integrated with the photosensitive member 109 and only the manufacturer's engineer such as a service person is allowed to detach the optical scanning device. It is, therefore, possible to maintain positioning accuracy to position the optical scanning system serving as the optical scanning device 100 and the photosensitive member 109 relative to each other.

Furthermore, since the engine units 2C, 2M, 2Y and 2K are integrated into one unit, it is possible to handle them more easily if only the engine units 2C, 2M, 2Y and 2K are detached from the image formation apparatus and sold as secondhand engine units or recycled.

Additionally, the other advantage of integrating the engine units into one unit is in that the service person can easily replace the engine units 2C, 2M, 2Y and 2K if unexpected trouble occurs to the engine units 2C, 2M, 2Y and 2K and the engine units must be replaced before the end of the life of the image formation apparatus main body.

In addition, the length between the section in which a toner image is transferred from the intermediate transfer belt 8 to the recording sheet and the section in which the recording sheet is discharged from the fixing device 7 is set shorter than the width of the available recording sheet in transport direction. This is intended to remove clogged recording sheets if the fixing device 7 or the like of the transfer fixing unit is clogged with sheets.

[Fixing Mechanism and Attachment/Detachment Mechanism for Life-Lengthened Engine Units]

A mechanism which fixes the engine units 2C, 2M, 2Y and 2K to the image formation apparatus main body will now be explained.

Figure 9:
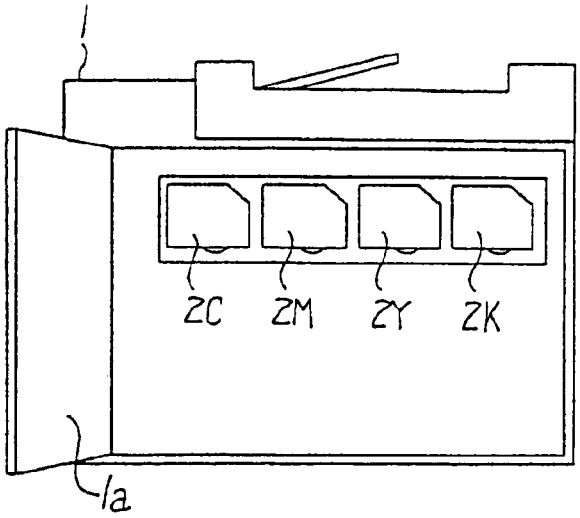
FIG. 9 is a schematic front view which shows a state in which a door provided on the front surface of the engine unit is opened.

FIG. 9 shows a state in which a door 1*a* provided on the front surface of the image formation apparatus 1 is opened. This door 1*a* is provided to replace the engine units 2C, 2M, 2Y and 2K or to repair the clogging of recording sheets.

In FIG. 9, when the door 1*a* is opened, the four engine units 2C, 2M, 2Y and 2K appears in an aligned state.

Figure 10:
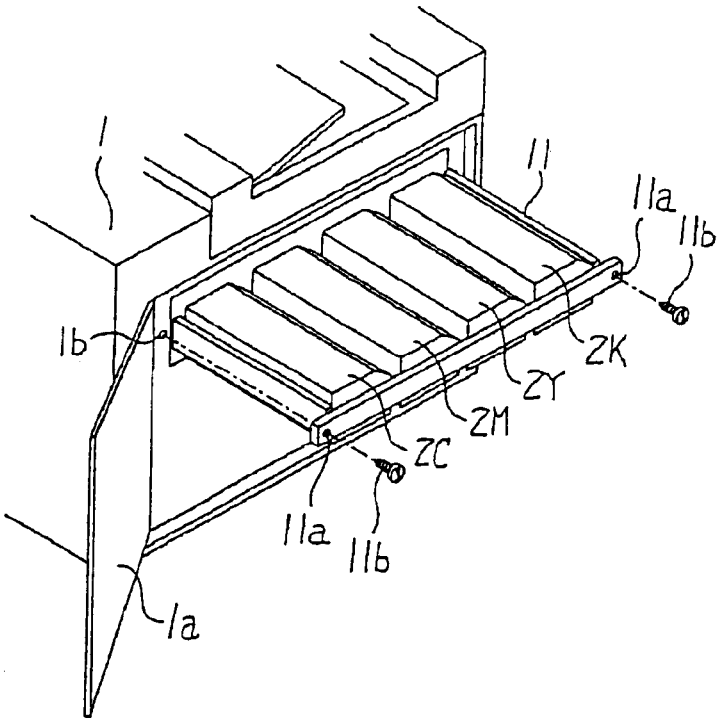
FIG. 10 is a schematic perspective view which shows a state in which the door provided on the front surface of the engine unit is opened and in which the engine unit is detached from the image formation apparatus main body.

As shown in FIG. 10, each of the engine units 2C, 2M, 2Y and 2K is supported by a support member 11, whereby the four engine units 2C, 2M, 2Y and 2K and the support member 11 can be integrally attached and detached.

Further, two screw holes 11*a* are provided on the both ends of the support member 11, respectively. Two screws 11*b* are inserted into these screw holes 11*a* and fitted into screw holes 11*b* on the front surface of the image formation apparatus main body, respectively, thereby fixing the support member 11 to the front surface of the image formation apparatus main body.

Figure 11:
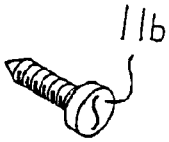
FIG. 11 is a schematic perspective view which shows one example of a screw which is used to attach and detach a support member which fixes the engine unit to the image formation apparatus main body.

The screws 11*b* used herein are not ordinarily used plus screws or minus screws but the driver hole of each screw is formed into, for example, an S-shaped curved hole as shown in FIG. 11. Namely, the screws 11*b* are constituted to be attachable and detachable only when, for example, a service person entrusted by the manufacturer uses a special driver which is adapted to the screws 11*b* and which only the service person is permitted to own, and constituted not to be attachable and detachable using any other commercially available ordinary driver.

Figure 12:
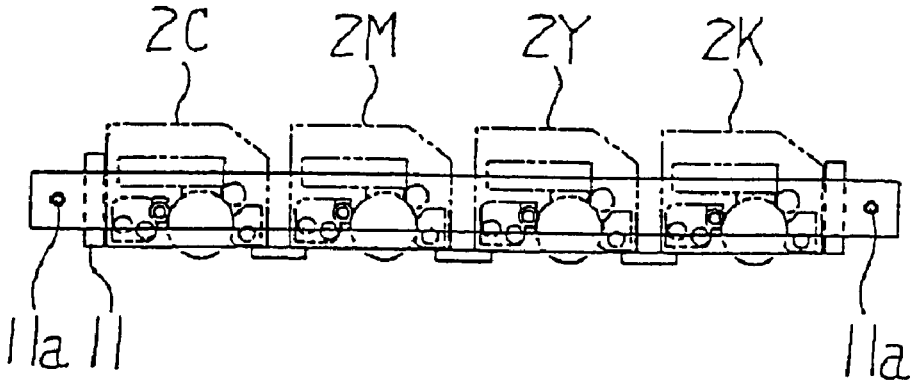
FIG. 12 is a schematic front view of the support member which is viewed from the forward direction of the image formation apparatus.
Figure 13:
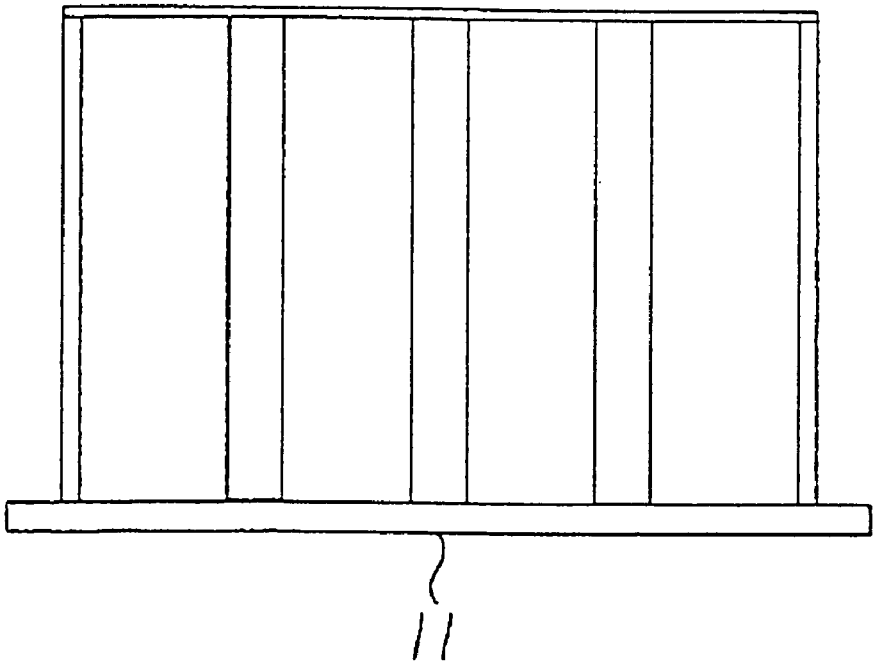
FIG. 13 is a schematic plan view of the support member which is viewed from the upward direction of the image formation apparatus.
Figure 14:
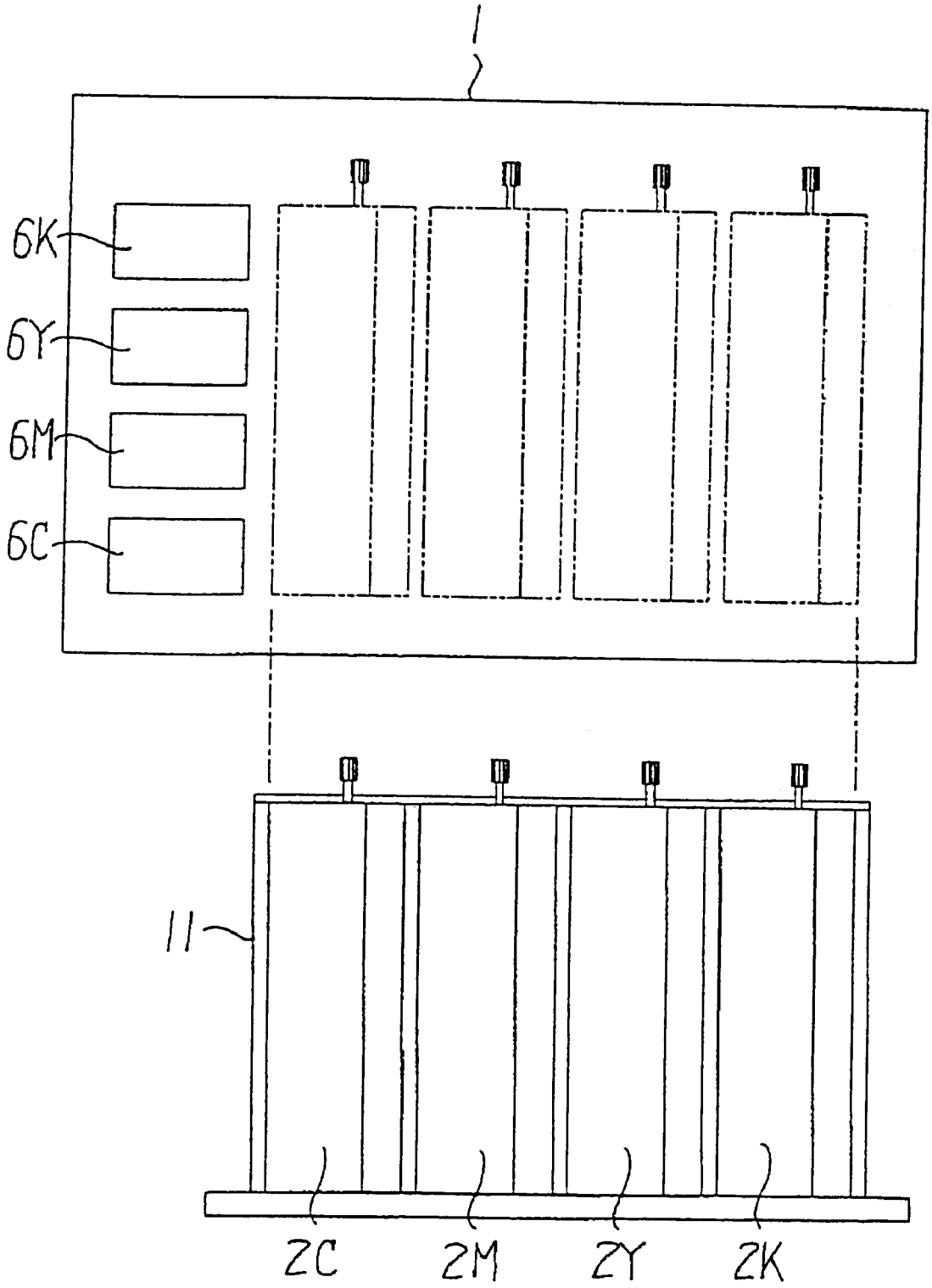
FIG. 14 is a schematic plan view which shows a state in which the engine units are detached from the image formation apparatus main body.

The configuration of the support member 11 will next be explained. FIG. 12 is a schematic front view of the support member 11 viewed from the forward direction of the image formation apparatus 1. FIG. 13 is a plan view thereof viewed from the upward direction of the image formation apparatus 1. As shown in FIGS. 12 and 13, the support member 11 is formed into such a shape as to support the both sides of each of the engine units 2C, 2M, 2Y and 2K. By doing so, it is possible to contact the photosensitive member 109 with the intermediate transfer belt 8 while each of the engine units 2C, 2M, 2Y and 2K is supported by the support member 11 during image formation operation.

Further, when the engine units 2C, 2M, 2Y and 2K are to detached, the engine units 2C, 2M, 2Y and 2K as well as the support member 11 are detached from the image formation apparatus main body integrally with one another. As can be seen, the engine units 2C, 2M, 2Y and 2K are constituted to be able to be simultaneously detached from the image formation apparatus main body by pulling out the support member 11. The detail of this configuration will be explained hereinafter.

Figure 15:
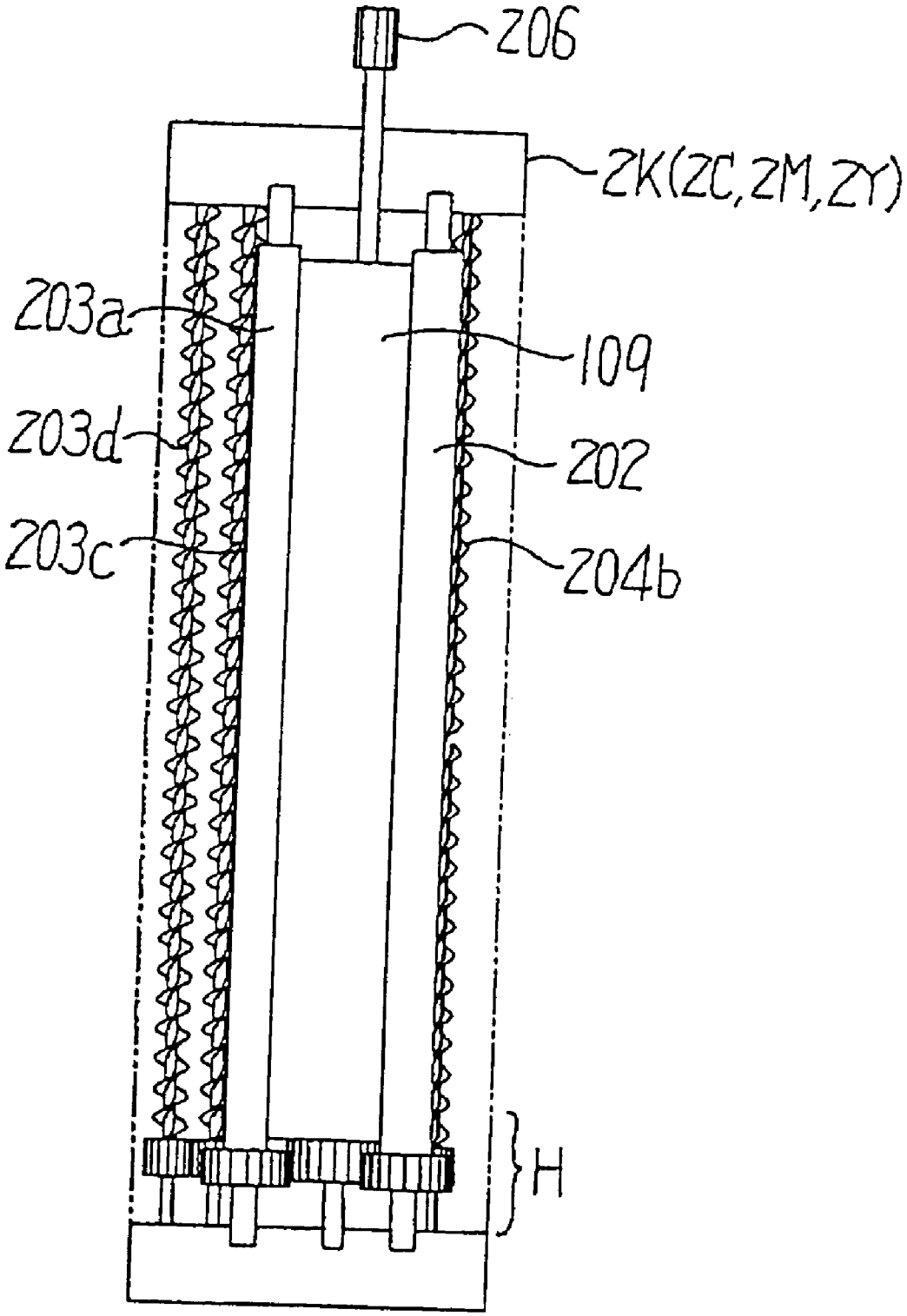
FIG. 15 is a schematic plan view which shows the internal structure of each engine unit.

FIG. 15 shows the internal structure of each of the engine units 2C, 2M, 2Y and 2K. In FIG. 15, a driving force to drive the respective image formation units of each engine unit 2C, 2M, 2Y and 2K is transmitted from a motor (not shown) provided in the image formation apparatus main body to the engine unit through a gear 206 provided on one end of the photosensitive member 109.

The driving force is transmitted from the photosensitive member 109 which rotates through the gear 206 to the respective other image formation units of each engine unit by directly engaging a gear provided on the other end of the photosensitive member 109 with a gear provided on the end section of each of the charging device 202, the development roller 203*a*, the mixing screws 203*c* and 203*d* and the waste toner transport screw 204*b* in a H region shown in FIG. 15.

Figure 16:
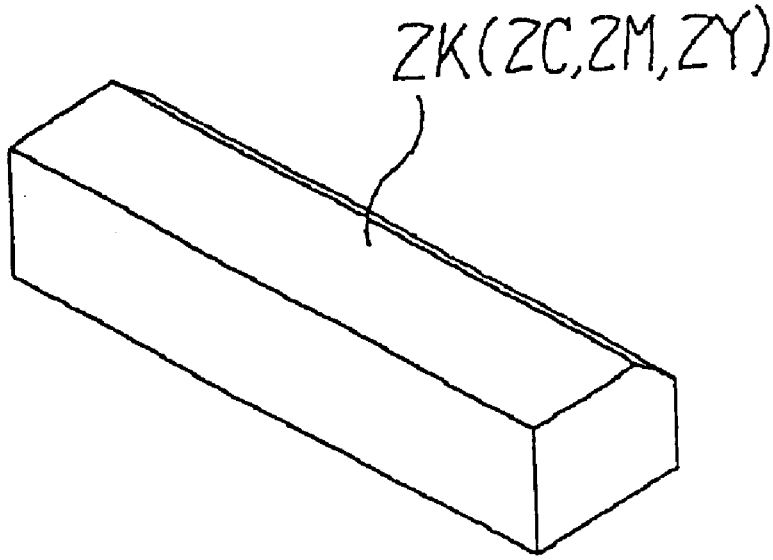
FIG. 16 is a schematic perspective view of each engine unit which is viewed from the upward direction of the front surface of the image formation apparatus.
Figure 17:
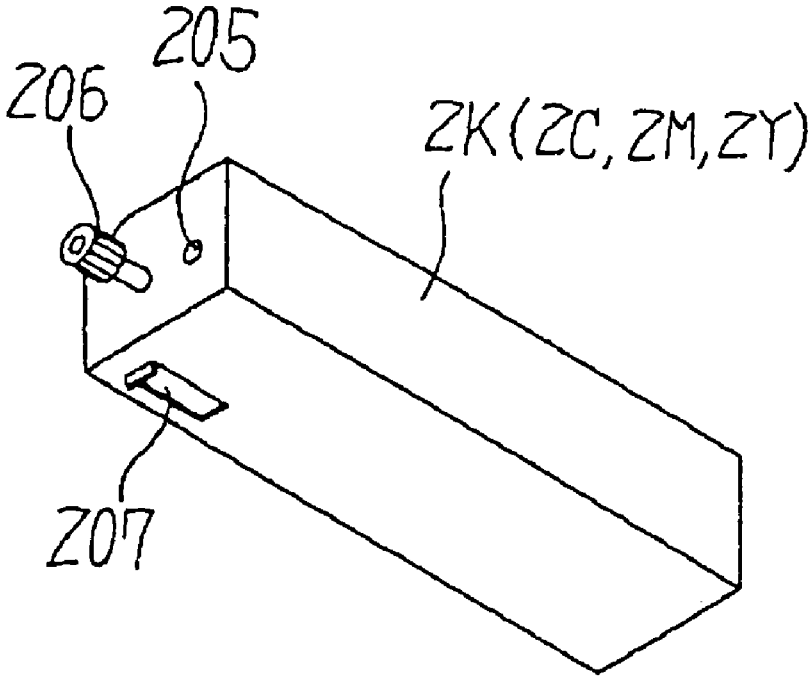
FIG. 17 is a schematic perspective view of each engine unit which is viewed from the downward direction of the rear surface of the image formation apparatus.

FIG. 16 is a schematic perspective view of the engine unit 2K (2C, 2M, 2Y) viewed from the upward direction of the front surface of the image formation apparatus. FIG. 17 is a schematic perspective view of the engine unit 2K (2C, 2M, 2Y) viewed from the downward direction of the rear surface of the image formation apparatus.

As is obvious from FIGS. 16 and 17, each of the engine units 2C, 2M, 2Y and 2K is constituted so that the respective image formation units as well as the driving force transmission unit thereof are not seen from the outside if viewed from the front surface direction of the image formation apparatus.

On the other hand, each of the engine units 2C, 2M, 2Y and 2K is constituted so that only the gear 206, an elastic member 205 and a shutter mechanism 207 to be explained later are seen if viewed from the rear direction of the image formation apparatus.

That is, each of the engine units 2C, 2M, 2Y and 2K is constituted to be coupled to the image formation apparatus main body through the gear 206, the elastic member 205 and the shutter mechanism 207 when attached to the image formation apparatus main body, thereby making it possible to perform image formation operation.

Figure 18A:
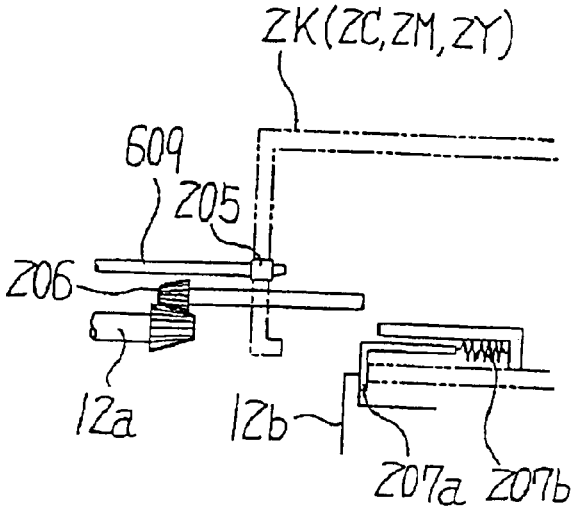
FIG. 18A and FIG. 18B are schematic cross-sectional views of a mechanism which is coupled with respect to the image formation apparatus main body each engine unit which is viewed from the side surface of the image formation apparatus.
Figure 18C:
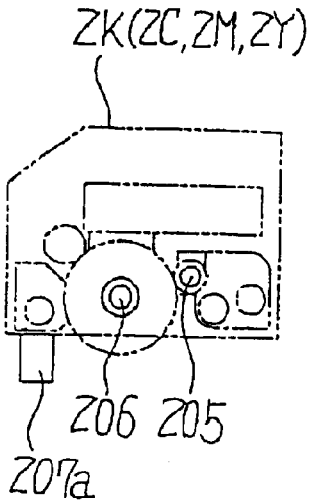
FIG. 18C is a schematic front view of each engine unit.
Figure 18B:
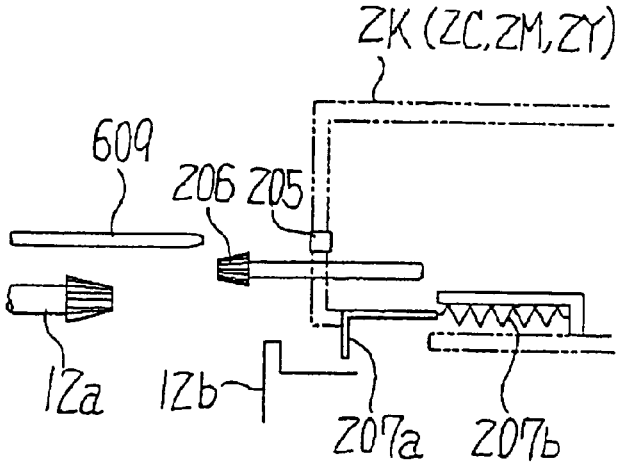

FIGS. 18A, 18B and 18C show a mechanism which couples each of the engine units 2C, 2M, 2Y and 2K to the image formation apparatus main body through the gear 206, the elastic member 205 and the shutter mechanism 207.

FIGS. 18A and 18B are schematic cross-sectional views of each of the engine units 2C, 2M, 2Y and 2K viewed from the side surface of the image formation apparatus. FIG. 18C is a schematic front view of each of the engine units 2C, 2M, 2Y and 2K. FIGS. 18A and 18C are put side by side so as to show the correspondence of the schematic cross-sectional view of each of the engine units 2C, 2M, 2Y and 2K to the schematic front view thereof.

In FIGS. 18A and 18B, the elastic member 205 is formed out of a notched rubber member. The pipe 609 used to introduce toner into the casing of the development device 203 is inserted into each of the engine units 2C, 2M, 2Y and 2K through this elastic member 205.

While the pipe 609 is inserted into each of the engine units 2C, 2M, 2Y and 2K, the elastic member 205 is open inward of each of the engine units 2C, 2M, 2Y and 2K. While the pipe 609 is not inserted into each of the engine units 2C, 2M, 2Y and 2K, the elastic member 205 seals the insertion path of the pipe 609 and functions as a valve which prevents the toner contained in the casing of the development device 203 in each of the engine units 2C, 2M, 2Y and 2K from leaking outside.

By constituting each of the engine units 2C, 2M, 2Y and 2K to supply toner from the outside of the engine unit, it is unnecessary to detach each engine unit from the image formation apparatus main body only for the supply of toner. Accordingly, the configuration of each engine unit to supply toner from the outside is preferable so as to continuously use the engine unit 2C, 2M, 2Y and 2K for long time.

The shutter mechanism 207 consists of an L-shaped member 207*a* and an urging spring 207*b*.

If each of the engine units 2C, 2M, 2Y and 2K is attached to the image formation apparatus, the L-shaped member 207*a* moves right against the elastic force of the urging spring 207*b* as shown in FIG. 18A. As a result, an output port through which the waste toner transport screw 204*b* discharges waste toner to the outside of each of engine units 2C, 2M, 2Y and 2K, is opened.

On the other hand, if each of the engine units 2C, 2M, 2Y and 2K are attached to the image formation apparatus, the L-shaped member 207*a* moves left by the elastic force of the urging spring 207*b* as shown in FIG. 18B. As a result, the waste toner output port is closed so as not to be spilled from each engine unit 2C, 2M, 2Y and 2K.

By constituting each of the engine units 2C, 2M, 2Y and 2K to discharge waste toner to the outside thereof, the waste toner is not accumulated in each of the engine units 2C, 2M, 2Y and 2K. It is, therefore, unnecessary to detach each engine unit from the image formation apparatus main body only for the discharge of waste toner and to continuously use the engine unit 2C, 2M, 2Y and 2K for long time.

It is also possible that a waste toner container is provided inside of each of the engine units 2C, 2M, 2Y and 2K. According to this configuration, however, it is necessary to provide a huge waste toner container so that the engine units 2C, 2M, 2Y and 2K the lives of which are lengthened can be continuously used, unfavorably making each of the engine units 2C, 2M, 2Y and 2K large in size.

To take out the waste toner without providing a mechanism which discharges the waste toner to the outside of each of the engine units 2C, 2M, 2Y and 2K and without making each engine unit large in size, the development of a technique of completely transferring a toner image on the photosensitive member 109, the development of a technique of reabsorbing residual toner in the development device 203 and the like may be considered.

In the state shown in FIG. 18A, by contrast, each of the engine units 2C, 2M, 2Y and 2K is attached from the image formation apparatus main body and can perform image formation operation.

The gear 206 provided in each of the engine units 2C, 2M, 2Y and 2K is directly engaged with the driving gear 12*a* provided in the image formation apparatus main body. This engagement enables the driving force of the motor (not shown) provided in the image formation apparatus main body to be transmitted to the gear 206 of each engine unit 2C, 2M, 2Y and 2K through the driving gear 12*a*.

In this embodiment, the pipe 609 is inserted into each of the engine units 2C, 2M, 2Y and 2K while opening the elastic member 205 inward, whereby a toner supply mechanism to be explained later can supply toner.

Further, in this state, the L-shaped member 207*a* is moved by a convex section 12*b* provided on the image formation apparatus main body in a direction in which the urging spring 207*b* is compressed and the waste toner output port is opened. It is thereby possible to discharge the waste toner into the waste toner container.

In the state shown in FIG. 18B, by contrast, each of the engine units 2C, 2M, 2Y and 2K is detached from the image formation apparatus main body and cannot perform image formation operation. At this moment, the gear 206 of each engine unit is not engaged with the driving gear 12*a* so as not to transmit the driving force of the motor (not shown) provided in the image formation apparatus main body.

Further, in this state, the pipe 609 is not inserted into each of the engine units 2C, 2M, 2Y and 2K and the elastic member 205 is closed so as not to leak toner from each of the engine units 2C, 2M, 2Y and 2K. In this state, as explained above, the L-shaped member 207*a* is moved by the elastic force of the urging spring 207*b* in the direction in which the waste toner output port is closed. As a result, the waste toner is prevented from flowing out of each of the engine units 2C, 2M, 2Y and 2K.

With the constitution of each of the engine units 2C, 2M, 2Y and 2K in this embodiment as explained above, it is possible to easily detach each of the engine units 2C, 2M, 2Y and 2K from the image formation apparatus main body by pulling out the support member 11 from the image formation apparatus.

In addition, by forcing the support member 11 into the image formation apparatus, it is possible to easily couple each of the engine units 2C, 2M, 2Y and 2K to the image formation apparatus main body.

Accordingly, when each of the engine units 2C, 2M, 2Y and 2K is detached from the image formation apparatus, operations other than the detachment of the screw 11*b* which serves as a fixing unit are not at all required, thereby ensuring good operationality.

Furthermore, since makeup toner is supplied from the outside of each of the engine units 2C, 2M, 2Y and 2K and waste toner is discharged to the outside thereof, the toner contained in each engine unit is not exhausted or each engine unit is not filled with the waste toner and made inoperable before the end of the life of each engine unit.

Figure 19:
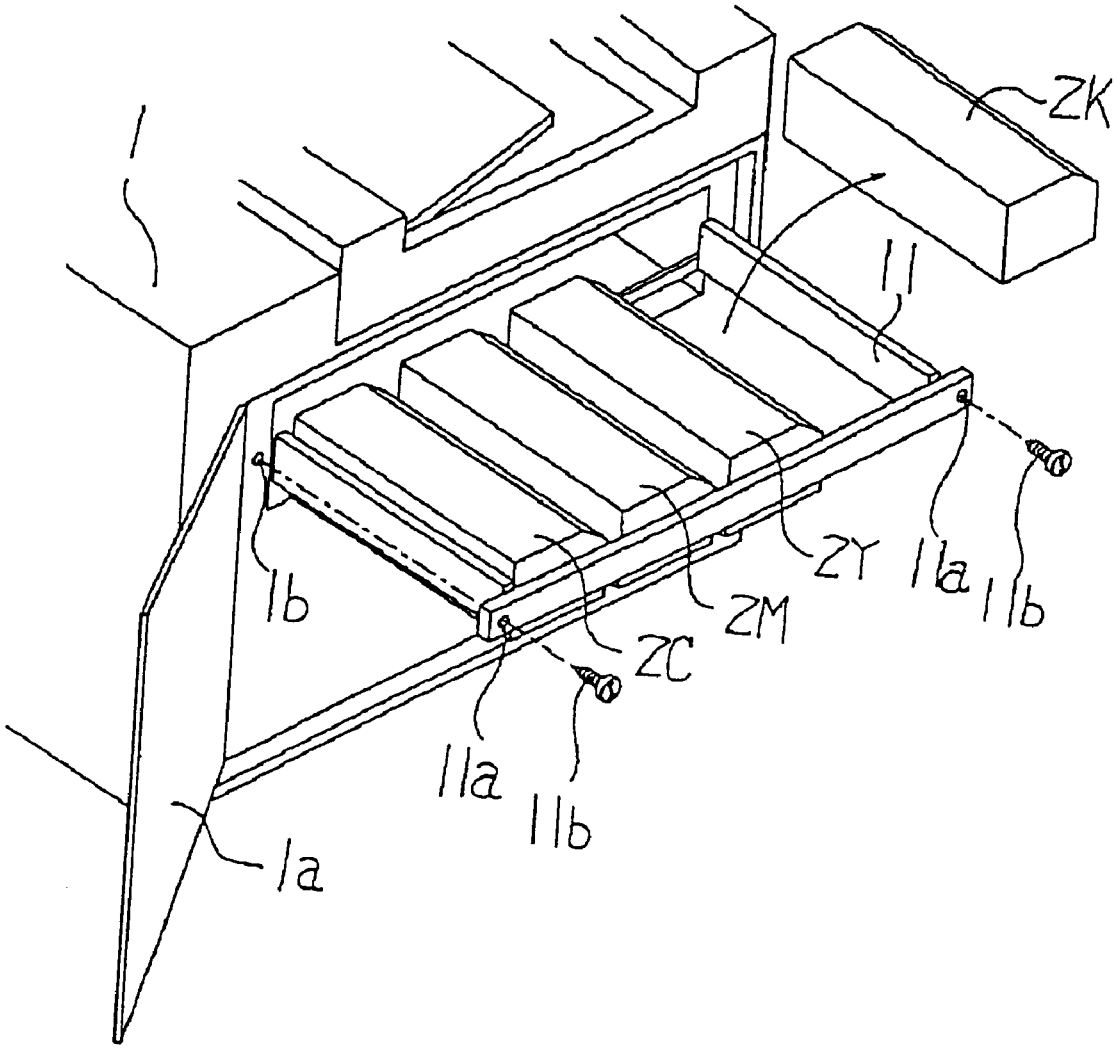
FIG. 19 is a schematic perspective view which shows a state in which the engine units are detached from the image formation apparatus.

FIG. 19 is a conceptual view which shows the attachment and detachment of each of the engine units 2C, 2M, 2Y and 2K in the image formation apparatus in this embodiment.

In FIG. 19, if a grip or the like is provided at each of the support member 11 and the engine units 2C, 2M, 2Y and 2K, the operationality of each engine unit during attachment and detachment further improves.

Figure 23A:
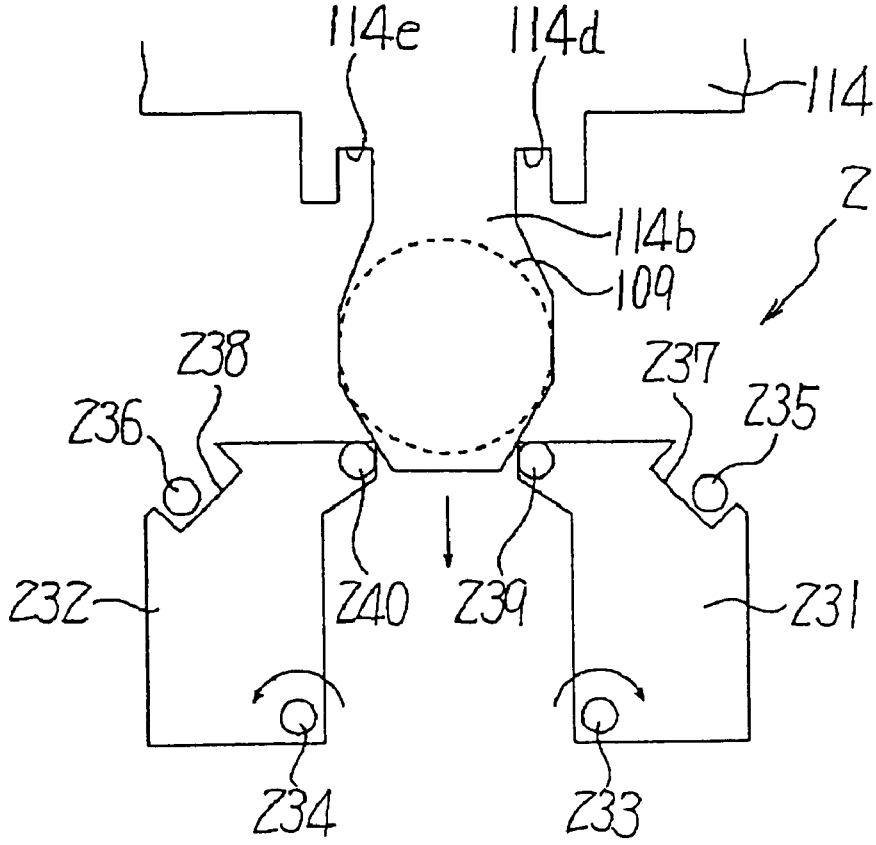
FIGS. 23A and 23B are schematic side views which show a positioning mechanism and the like, FIG. 24 is a longitudinal side view which shows an example of the configuration of a conventional optical scanning device.
Figure 23B:
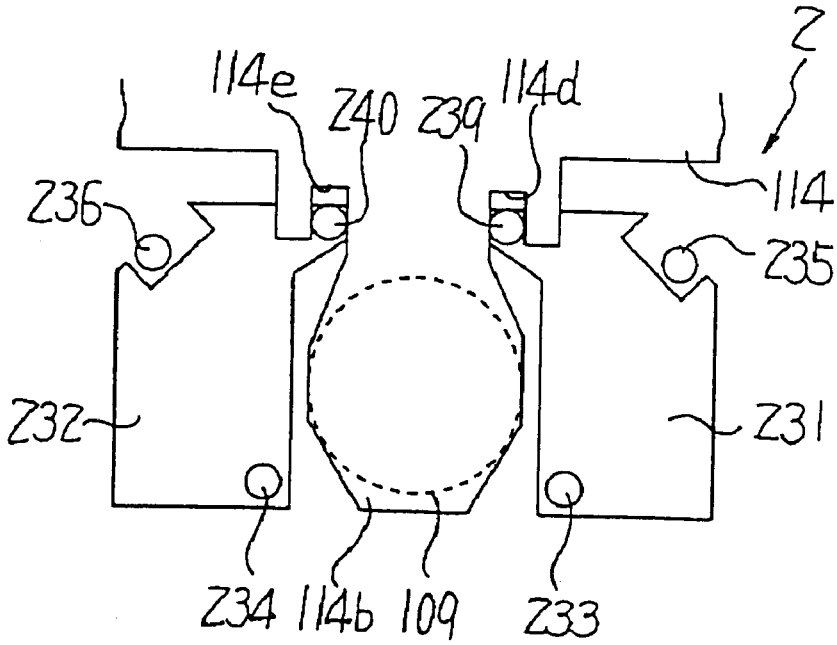

The configuration of the engine unit 2 in this embodiment will next be explained from another viewpoint. The engine unit 2 itself is constituted as shown in, for example, FIG. 7. More specifically, as shown in FIG. 23A and FIG. 23B, there are provided a charging and cleaning unit 231 in which the cleaning device 204 is integrated with the charging device 202 and a development unit 232 obtained by forming the development device 203 into a unit, relative to the optical scanning device 100 having the exposure unit integral with the photosensitive member 109. The charging and cleaning unit 231 and the development unit 232 are made rotatable relative to the engine unit 2 by supporting points 233 and 234, respectively. In addition, the units 231 and 232 have notches 237 and 238 fitted into fixed pins 235 and 236 provided on parts of the engine unit 2, respectively, thereby restricting the rotation ranges of the units 231 and 232. Further, the units 231 and 232 are urged in the direction of the photosensitive member 109 by springs (not shown), respectively.

The housing 114 of the optical scanning device 100 which forms an important part of the engine unit 2 is inserted from above along a guide (not shown) provided on the image formation apparatus main body. At this moment, the fixed pins 239 and 240 provided in the rotatable units 231 and 232, respectively, contact with the outside of the holding section 114*b* of the housing 114 and rotate in a direction in which the units 231 and 232 retreat from the photosensitive member 109 (which is a direction indicated by an arrow in FIG. 23A). Further, if the housing 114 is further inserted, the fixed pins 239 and 240 are fitted into notches 114*d* and 114*e* formed on parts of the housing 114 and serving as positioning mechanisms, respectively, to thereby fixedly position the housing 114 relative to the photosensitive member 109 as shown in FIG. 23B. If the optical scanning device 100 is detached, the opposite operation may be performed to thereby prevent the photosensitive member 109 from being damaged.

In this embodiment, an example in which each of the engine units 2C, 2M, 2Y and 2K, in which the optical scanning device 100 (including the photosensitive member 109), the charging device 202, the development device 203, the cleaning device 204 and the like are integrated with one another into one unit, and which is constituted not to be detachable from the image formation apparatus main body unless a dedicated tool is used, is assembled with the image formation main body has been explained. However, the present invention is not limited to this embodiment.

For example, the image formation apparatus may be constituted so that the optical scanning device can be replaced solely and that by replacing a plurality of types of optical scanning devices different in performance related to pixel density with one another, the performance related to pixel density of the overall apparatus is changed. Alternatively, the image formation apparatus may be constituted differently from this embodiment, so that a visible image formation unit in which only process units around the photosensitive member such as the charging device and the development device formed separately from the optical scanning device are integrated with one another, is provided as an image formation unit, and that by replacing a plurality of image formation units different in performance related to recording speed (visible image formation speed) with one another, the performance related to recording speed of the overall image formation apparatus is changed. Alternatively, the image formation apparatus may be constituted so that an image formation unit consisting of the optical scanning device and an image formation unit consisting of process devices such as the charging device and the development device are replaceable independently of each other.

Namely, according to the present invention, it is significant that components (such as the optical scanning device, the visible image formation unit mainly consisting of the components around the photosensitive member and the fixing device) which need to be changed so as to change resolution, recording speed and fixing rise time as the performances of the image formation apparatus, can be replaced with those having different performances for each image formation unit. It is, therefore, possible to obtain a novel advantage that if a user wants to have the performance of the image formation apparatus changed, it is unnecessary to change the overall image formation apparatus but it suffices to replace only the image formation unit with another image formation unit which has the user desired performance.

Moreover, in this embodiment, the optical scanning device 100 integrated with the photosensitive member 109 is basically, fixedly assembled into the image formation apparatus main body and only the manufacturer's engineer such as a service person is allowed to detach the optical scanning device from the main body. It is, therefore, possible to maintain the positional accuracy between the scanning optical system and the photosensitive member 109 as long as possible, to ensure recovering the components and to easily recycle these components.

Needless to say, the assembly structure with which the optical scanning device cannot be detached from the main body without using a special tool is not limited to this embodiment but various structures can be adopted.

In addition, an example in which the image formation apparatus in this embodiment is applied to a color image formation apparatus, has been explained. Needless to say, the image formation apparatus is also applicable to a monochrome image formation apparatus.

Moreover, the performance information is stored, as electronic information, in the memory of each image formation unit in this embodiment. Alternatively, it is also possible that protrusions (or recesses) according to a predetermined rule are formed in a predetermined section of each image formation unit, and that the protrusions (or recesses) are fitted into recesses (or protrusions) formed according to a corresponding rule on the image formation apparatus main body side, whereby the type of the image formation unit attached to the main body is specified and information on the performance corresponding to the type of the image formation unit and stored in the memory 223 of the image formation apparatus main body is acquired.

Furthermore, an example in which the semiconductor laser 101 is used as the light source has been explained in this embodiment. However, the light source is not limited to the semiconductor laser but may be an LED or the like. Besides, the light source is not limited to a single light source type but may be such a type as to simultaneously write a plurality of lines by using a semiconductor laser array having a plurality of light emitting points, a plurality of semiconductor laser systems, an LED array or the like. Further, the photosensitive member which serves as the scanning target medium or the image carrier is not limited to the drum-shaped member but may be a belt-shaped member.

Additionally, the present invention is applicable not only to the electrophotographic type image formation apparatus but also to an inkjet type image formation apparatus or the like which employs image formation process other than electronic photograph formation process.

According to one aspect of the present invention, there is provided an image formation unit, the image formation unit includes at least one process unit which forms an image, is replaceable and is attached to an image formation apparatus main body, and holds performance information on a performance of the unit in a format in which the image formation main body, the performance of which is to be changed according to the performance information, can acquire the performance information. Therefore, only by attaching the image formation unit having a desired performance to the image formation apparatus main body in a replaceable manner, it is possible to change the performance of the overall apparatus according to the performance of the image formation unit. In addition, it is possible to realize an image formation apparatus which has the desired performance without the need to purchase another image formation apparatus main body.

According to another aspect of the present invention, relating to the image formation unit recited in the above aspect, the image formation unit is formed into a unit which comprises, as the process unit, at least a visible image formation unit which forms a visible image, and the performance information on the performance of the unit is information which represents visible image formation speed. Therefore, only by attaching the image formation unit having a desired performance related to the visible image formation speed to the image formation apparatus main body in a replaceable manner, it is possible to change the performance of the overall apparatus according to the performance related to the visible image formation speed of the image formation unit. In addition, it is possible to realize an image formation apparatus which has the desired performance on the visible image formation speed without the need to purchase another image formation apparatus main body.

According to still another aspect of the present invention, relating to the image formation unit recited in the above aspects, the image formation unit is formed into a unit which comprises, as the process unit, at least a writing unit which writes a latent image or a visible image with a predetermined density in accordance with image information, and the performance information on the performance of the unit is information which represents pixel density. Therefore, only by attaching the image formation unit having a desired performance related to the pixel density to the image formation apparatus main body in a replaceable manner, it is possible to change the performance of the overall apparatus according to the performance related to the pixel density of the image formation unit. In addition, it is possible to realize an image formation apparatus which has the desired performance on the pixel density without the need to purchase another image formation apparatus main body.

According to still another aspect of the present invention, relating to the image formation unit recited in any one of the above aspects, the image formation unit comprises, as the process unit, at least an image carrier and a writing unit which forms a latent image on the image carrier, and the image carrier and the writing unit are held in a single housing to be integrated into one unit. Therefore, even if pixel density is changed by replacing the image formation unit without changing the image formation apparatus main body, for example, it is possible to widen a depth margin, to satisfy the desired specification of a beam spot diameter, to decrease the degradation of image quality by integrating a scanning optical system which functions as the writing unit with the image carrier and thereby reducing the irregularity of the distance between the scanning optical system and the image carrier. In addition, since the depth margin is widened, it is possible to the widened margin to the processing errors of the other optical components and the holding members and to increase the quantity of tolerances allotted to each component.

According to still another aspect of the present invention, relating to the image formation unit recited in the above aspect, the image formation unit is formed into a unit which comprises, as the process unit, at least a fixing unit which fixes a toner image onto a recording target, and the performance information on the performance of the unit is information which represents necessary time from a state in which the fixing unit is stopped or dormant to a state in which the fixing unit can perform a fixing operation. Therefore, only by attaching the image formation unit having a desired performance related to the fixing rise time to the image formation apparatus main body in a replaceable manner, it is possible to change the performance of the overall apparatus according to the performance related to the fixing rise time of the image formation unit. In addition, it is possible to realize an image formation apparatus which has the desired performance on the fixing rise time without the need to purchase another image formation apparatus main body.

According to still another aspect of the present invention, relating to the image formation unit recited in any one of the above aspects, the image formation unit comprises a non-volatile storage unit which stores, as electronic information, the performance information on the performance of the unit and which is readable by the image formation apparatus main body by attaching the unit to the image formation apparatus main body. Therefore, it is possible to ensure that the image formation apparatus main body acquires the performance information on the performance of the unit.

According to still another aspect of the present invention, relating to the image formation unit recited in any one of the above aspects, units having different performances have an equal outside structure. Therefore, it is possible to use image formation units having different performances and to easily change the performance of the overall apparatus without the need to change the structure or the like of the image formation apparatus main body.

According to still another aspect of the present invention, an image formation apparatus including a plurality of process units which forms an image, comprises: an image formation unit according to any one of the above aspects, which includes at least one process unit among the plurality of process units, and which is replaceable and is attached to an image formation apparatus main body; a performance acquisition unit which acquires performance information on a performance of the image formation unit from the image formation unit attached to the image formation apparatus main body; and a control unit which changes a performance of the overall image formation apparatus in accordance with the acquired performance information, whereby the performance of the overall apparatus is controlled based on the performance of the image formation unit attached thereto in a replaceable manner. Therefore, only by attaching the image formation unit having a desired performance to the image formation apparatus main body in a replaceable manner, it is possible to realize an image formation apparatus which has the desired performance without the need to purchase another image formation apparatus main body.

The present document incorporates by reference the entire contents of Japanese priority document, 2001-085511 filed in Japan on Mar. 23, 2001 and 2002-049777 filed in Japan on Feb. 26, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation unit comprising:

at least one process unit replaceably attached to an image formation apparatus main body and configured to form an image; and a storage unit configured to store performance information on a performance of the image formation unit in a format in which the image formation main body can acquire the performance information, wherein a performance of the image formation body is changed according to the performance information stored in the storage unit of the image formation unit, wherein the image formation unit is formed into a unit which comprises, as the process unit, at least a fixing unit which fixes a toner image onto a recording target, and wherein the performance information on the performance of the unit is information which represents a necessary time from a state in which the fixing unit is stopped or dormant to a state in which the fixing unit can perform a fixing operation.

2. An image formation apparatus, comprising:

a plurality of image formation units including at least one process unit and being replaceably attached to an image formation apparatus main body and configured to form an image, each of the plurality of image formation units including a storage unit configured to store performance information on a performance of a respective one of the plurality of image formation units in a format in which the image formation main body can acquire the performance information, a performance of the image formation body being changed according to the performance information stored in the storage unit of the respective one of the plurality of image formation units;

a performance acquisition unit configured to acquire performance information on a performance of the plurality of image formation units attached to the image formation apparatus main body;

a determination unit configured to determine whether or not corresponding pieces of performance information for each of the plurality of image formation units are the same;

a notification unit configured to notify a warning signal when the corresponding pieces of performance information for each of the plurality of image formation units are not the same; and a control unit configured to change a performance of the overall image formation apparatus in accordance with the acquired performance information.

3. The image formation apparatus according to claim 2, wherein each of the image formation units is formed into a unit which comprises, as a process unit, at least a visible image formation unit which forms a visible image; and the performance information is information which represents visible image formation speed.

4. The image formation apparatus according to claim 2, wherein each of the image formation units is formed into a unit which comprises, as a process unit, at least a writing unit which writes a latent image or a visible image with a predetermined pixel density in accordance with image information; and the performance information is information which represents pixel density.

5. The image formation apparatus according to claim 2, wherein each of the image formation units comprises, as a process unit, at least an image carrier and a writing unit which forms a latent image on the image carrier; and the image carrier and the writing unit are held in a single housing to be integrated into one unit.

6. The image formation apparatus according to claim 2, wherein the storage unit comprises a nonvolatile storage unit which stores, as electronic information, the performance information and which is readable by the image formation apparatus main body by attaching the plurality of image formation units to the image formation apparatus main body.

7. The image formation apparatus according to claim 2, wherein the plurality of image formation units having different performances have an equal outside structure.

* * * * *